US009980526B2

(12) United States Patent
Silverberg

(10) Patent No.: US 9,980,526 B2
(45) Date of Patent: May 29, 2018

(54) TEMPERATURE REGULATING GARMENT

(71) Applicant: Mark Silverberg, Deerfield, IL (US)

(72) Inventor: Mark Silverberg, Deerfield, IL (US)

( * ) Notice: Subject to any disclaimer, the term of this patent is extended or adjusted under 35 U.S.C. 154(b) by 19 days.

(21) Appl. No.: 15/004,654

(22) Filed: Jan. 22, 2016

(65) Prior Publication Data

US 2016/0135517 A1 May 19, 2016

Related U.S. Application Data

(63) Continuation-in-part of application No. 14/513,429, filed on Oct. 14, 2014, which is a continuation-in-part
(Continued)

(51) Int. Cl.
*A41D 13/005* (2006.01)
*A41D 13/12* (2006.01)
*A41F 9/00* (2006.01)

(52) U.S. Cl.
CPC ..... *A41D 13/0058* (2013.01); *A41D 13/005* (2013.01); *A41D 13/0051* (2013.01); *A41D 13/1209* (2013.01); *A41F 9/00* (2013.01)

(58) Field of Classification Search
CPC ..... A41D 13/0058; A41D 13/0051; A41D 13/0053; A41D 1/002; A41D 1/005; A41D 1/02; A41D 13/0012; A41D 27/20; A41D 27/204; A41D 27/205; A41D 13/0525; A41D 1/04; A41D 13/005; A41D 27/208; A41D 2200/10; A41D 2400/10; A41D 2400/12; A41D 13/1209; A41D 13/12; A41D 27/02; A41D 27/04; A61F 2007/0023; A61F 2007/0228;
(Continued)

(56) References Cited

U.S. PATENT DOCUMENTS 139,950 A 6/1873 Garaud
191,027 A * 5/1877 Case ..... A45C 13/02 2/94
(Continued)

FOREIGN PATENT DOCUMENTS

AU 2005100085 3/2005
CA 2214328 4/1999
(Continued)

OTHER PUBLICATIONS

International Search Report from International Patent Application No. PCT/US2015/039060, dated Sep. 30, 2015.
(Continued)

*Primary Examiner* — Amy Vanatta
(74) *Attorney, Agent, or Firm* — Greer, Burns & Crain, Ltd.

(57) ABSTRACT

A garment for regulating temperature is provided, with a body including a back panel and at least one front panel and at least partially joined along at least one common edge, an inner liner panel fastened to an inner surface of at least one of the back panel and to the at least one front panel with a first surface, and a second surface opposite to the first surface of the inner liner panel, and at least one pocket with top, bottom and side edges, being fastened to at least one of the first and second surfaces of the inner removable liner panel. The at least one pocket has at least one side opening.

15 Claims, 17 Drawing Sheets

Related U.S. Application Data of application No. 14/490,106, filed on Sep. 18, 2014, which is a continuation-in-part of application No. 14/324,707, filed on Jul. 7, 2014.

(58) Field of Classification Search

CPC ..... A61F 2007/0233; A61F 2007/0234; A61F 7/0018; A61F 7/0026; A61F 7/0027; A61F 2007/0001; A61F 2007/0018; A61F 2007/0019; A61F 2007/0022; A61F 2007/0024; A61F 2007/0026; A61F 2007/0027; A61F 7/007; A61F 2007/0078; A61F 2007/008; A61F 7/08; A61F 2007/0225; A61F 2007/023; A61F 2007/0231; A61F 2007/0236; A61F 2007/0238; A41F 9/002; A41F 9/025; A41F 9/02; A41F 9/00; A62B 17/005

USPC ..... 2/94, 108, 247, 248, 250, 251, 253, 254; 607/108, 112, 114

See application file for complete search history.

(56) References Cited

U.S. PATENT DOCUMENTS 939,871 A * 11/1909 Sherman ..... A41D 13/0012 2/94
992,376 A 5/1911 Moore
1,088,891 A 3/1914 Filson
1,444,750 A 2/1923 Moore
1,685,243 A * 9/1928 Rich ..... A01M 31/006 2/248
1,869,261 A * 7/1932 Jennings ..... A41D 27/20 2/247
2,048,880 A * 7/1936 Morgan ..... H05B 3/342 219/528
2,097,975 A * 11/1937 Habegger ..... A41D 27/20 2/247
2,104,699 A * 1/1938 O'Dell ..... A61F 5/028 450/127
2,260,427 A * 10/1941 Bailey ..... A41D 15/002 2/94
2,315,416 A 3/1943 Grady
2,322,510 A 6/1943 Dufine
2,331,962 A 10/1943 Collins
2,403,676 A 7/1946 Modlinski
2,428,477 A 10/1947 Thompson
2,565,023 A * 8/1951 Hepp ..... A41D 27/20 2/247
2,579,383 A * 12/1951 Goudsmit ..... H05B 3/342 2/102
2,584,302 A * 2/1952 Shachno ..... H05B 3/342 219/527
2,865,025 A 12/1958 Hennessey
2,873,449 A * 2/1959 Herbert ..... A01M 31/006 2/94
3,047,877 A 8/1962 Palazzo
3,055,133 A 9/1962 Anderson
3,296,819 A * 1/1967 Gough ..... A41D 13/0055 165/46
3,452,362 A * 7/1969 Korolick ..... F41H 1/02 2/2.5
3,500,014 A * 3/1970 Longo ..... H05B 3/342 219/211
3,501,616 A 3/1970 Arron
3,569,666 A * 3/1971 Murphy ..... A41D 19/01535 126/204
3,644,705 A * 2/1972 Johnson ..... H05B 3/342 219/211
3,950,789 A 4/1976 Konz et al.
4,527,566 A * 7/1985 Abare ..... A61F 7/02 601/15
4,532,410 A * 7/1985 Wehmeyer ..... A41D 23/00 219/211
4,637,075 A 1/1987 Ingrisano et al.
4,676,247 A * 6/1987 Van Cleve ..... A61F 7/02 607/112
4,681,113 A * 7/1987 Coplans ..... A61F 5/028 2/46
4,696,066 A 9/1987 Ball et al.
4,791,681 A 12/1988 Dean
5,014,360 A 5/1991 Smith et al.
5,031,244 A 7/1991 Inagaki
5,038,779 A 8/1991 Barry et al.
5,072,455 A * 12/1991 St. Ours ..... A41D 13/0055 2/102
5,146,625 A 9/1992 Steele et al.
5,148,002 A * 9/1992 Kuo ..... H01Q 1/273 219/211
5,215,080 A * 6/1993 Thomas ..... A61F 7/10 607/112
5,218,720 A 6/1993 Talton
5,302,806 A 4/1994 Simmons et al.
5,305,471 A 4/1994 Steele et al.
5,336,255 A * 8/1994 Kanare ..... A61N 1/0452 607/112
5,484,448 A 1/1996 Steele et al.
5,605,144 A 2/1997 Simmons et al.
5,652,961 A 8/1997 Knight-Yurt
5,694,646 A 12/1997 Roberts
5,718,000 A 2/1998 Ost et al.
5,787,505 A 8/1998 Piwko et al.
5,826,273 A 10/1998 Eckes
5,928,275 A * 7/1999 Yates ..... A61F 7/034 126/204
5,971,947 A * 10/1999 McNally ..... A61F 13/108 602/14
5,977,517 A * 11/1999 Grosjean ..... A41D 13/0051 219/211
6,574,800 B1 * 6/2003 Leger ..... A41D 13/1245 2/114
6,585,673 B1 * 7/2003 Bass ..... A61F 7/02 128/845
6,589,272 B1 * 7/2003 Sheikh ..... A61F 7/02 607/108
6,692,413 B1 2/2004 Greenberg et al.
6,763,527 B1 7/2004 Rivoli et al.
6,830,582 B1 * 12/2004 Reid, Jr. ..... A61F 7/103 601/15
6,931,875 B1 8/2005 Allen et al.
6,936,018 B2 * 8/2005 Chalek ..... A61F 7/02 128/876
7,022,093 B2 * 4/2006 Smith ..... A61F 5/0106 602/14
7,216,370 B1 5/2007 Warner et al.
7,396,272 B1 7/2008 Newlen
7,816,628 B2 10/2010 Fernandez et al.
D657,939 S 4/2012 Mathews
8,671,464 B2 3/2014 Silverberg
2004/0172734 A1 9/2004 Hartbrodt
2006/0253954 A1 11/2006 Music
2007/0006359 A1 * 1/2007 Godfrey ..... A41D 13/0058 2/69
2007/0057003 A1 3/2007 Keyes
2008/0093354 A1 4/2008 Fang et al.
2008/0116189 A1 5/2008 Fernandez et al.
2008/0201818 A1 8/2008 Nilforushan et al.
2009/0217440 A1 9/2009 Sutker
2009/0289046 A1 11/2009 Richmond
2011/0022137 A1 * 1/2011 Ennis-Thomas ... A41D 13/0053 607/108
2011/0041229 A1 2/2011 Niemi et al.
2012/0221083 A1 * 8/2012 Cruzada ..... A61F 7/02 607/112
2013/0090710 A1 * 4/2013 Rimoli ..... A47C 7/425 607/108
2014/0143928 A1 5/2014 Silverberg
2014/0157484 A1 * 6/2014 Ezell ..... A41D 13/0058 2/102

(56) References Cited

U.S. PATENT DOCUMENTS

| | | | | |
|---|---|---|---|---|
| 2015/0026862 | A1 | 1/2015 | Silverberg | |
| 2015/0359279 | A1 | 12/2015 | Chang | |
| 2017/0013890 | A1* | 1/2017 | Byrne | A41D 13/0058 |

FOREIGN PATENT DOCUMENTS

| | | | |
|---|---|---|---|
| CA | 2797436 | A1 | 6/2014 |
| CN | 203646537 | U | 6/2014 |
| CN | 104473338 | A | 4/2015 |
| DE | 20219895 | | 4/2003 |
| WO | 2005006896 | | 1/2005 |

OTHER PUBLICATIONS

International Search Report from International Patent Application No. PCT/US2017/013295, dated Apr. 10, 2017.

* cited by examiner

TEMPERATURE REGULATING GARMENT

RELATED APPLICATIONS

This application is a continuation-in-part of, and claims priority to U.S. patent application Ser. No. 14/513,429 filed Oct. 14, 2014, which is a continuation-in-part of, and claims priority to U.S. patent application Ser. No. 14/490,106 filed Sep. 18, 2014, which is a continuation-in-part of and claims priority to U.S. patent application Ser. No. 14/324,707 filed Jul. 7, 2014.

BACKGROUND

This invention relates generally to clothing, and more specifically to garments of the type worn by medical personnel in operating rooms, and other applications.

To create a proper working environment, medical operating rooms are usually maintained at a certain temperature which is often relatively cold to offset hot lighting, to keep stressed doctors and nurses comfortable while working, and/or to inhibit the spread of bacteria. In most hospitals, medical personnel are forbidden from bringing street clothing into the operating room. In some cases, anesthesiologists, nurses and any other personnel in the operating room who are not scrubbed in may wear a medical or hospital issue warm up jacket over their scrubs; however, these garments do not keep the wearer at a comfortable temperature. Excessive layers of garments are also counterproductive in the operating room, since they may restrict the mobility or dexterity of the personnel. On the other hand, limbs and fingers tend to get stiff when the body is cold.

Anesthesiologists, nurse anesthetists, perioperative nurses, and others participating in the operating room need their body to be at a comfortable level of temperature and dexterity to perform their functions over many hours. Additionally, medical personnel suffering from hormonal changes often have abnormal body temperature perceptions while participating in surgery. One example is post menopausal women, who suffer from periodic drastic perceived changes in body temperature and often feel much warmer than other individuals in the same room. Also, the surgical treatment of burn patients or pediatric patients usually requires the operating or treating room to be warmer than average for the patient's benefit. These situations have created a need for alternative measures for keeping medical personnel, or other users comfortable.

SUMMARY

The above-listed needs are met or exceeded by the present temperature regulating garment, usable in many situations when a wearer desires enhanced temperature regulation, and in particular for keeping operating room personnel at a desired temperature. A specially designed warm up jacket or vest is provided to be worn over scrubs. A version of the present garment is a specially designed vest provided to be worn over scrubs and under any sort of warm up jacket or surgical gown. In a preferred embodiment, the garment is made of a thermally insulating material, such as GORE® surgical fabric, preferably level 3 or 4. Furthermore, the present garment features at least one and preferably several pockets which are designed to releasably accommodate a temperature element such as a reusable heatable gel pack or chemical warming pack, cooling pack or the like.

It is contemplated that the size and locations of the temperature regulating elements are variable to suit the situation. The temperature regulating element can be a heating element, such as a battery-powered heating element, chemical warming pack, reusable heated gel pack or warmed up bag of IV fluid, or a cooling element, such as a phase change cooling element, chemical cooling pack, reusable cooled gel pack, refrigerated bag of IV fluid or ice packs. While preferably made of mesh material, the pockets are designed to allow the heat generated by the regulating elements to be distributed generally uniformly throughout an inside chamber defined by the present garment. The garment also features at least one single layer or double layer pocket, designed to hold a heating or cooling pack over the wearer's lumbar region. When provided as a vest, the present garment can be reversed to provide an additional layer of non-fenestrated material between the wearer and the temperature element. Such an additional layer is helpful when a cooling element is used to prevent the discomfort of localized cold upon the skin.

There also exists a need to easily launder garments with temperature regulating elements. After placing the elements into the pockets, the user has to remove each element before placing the garment into the laundry machine. This need is met by the present temperature regulating garment, which features an inner liner panel which has pockets for the temperature regulating elements. Therefore, it is contemplated that the inner liner panel is preferably removable, and the user removes the liner panel and launders the garment. After laundering, the liner panel is reattached to the garment.

More specifically, a garment for regulating temperature is provided, with a body including a back panel and at least one front panel and at least partially joined along at least one common edge, an inner liner panel fastened to an inner surface of at least one of the back panel and to the at least one front panel with an first surface, and a second surface opposite to the first surface of the inner liner panel, and at least one pocket with top, bottom and side edges, being fastened to at least one of the first and second surfaces of the inner liner panel. The at least one pocket has at least one side opening.

In another embodiment, a panel is provided for use with a garment for regulating temperature having a body including a back panel, at least one front panel, and is at least partially joined along at least one common edge, the joined panels defining an inside chamber. The panel has a web with a first surface, a second surface, right and left side edges, and at least one attachment disposed on the surface of the web of the panel. At least one pocket is provided having top, bottom, and side edges, and is fastened to the surface of the web of the panel on at least one said side edge of the at least one pocket. The at least one pocket has at least one side opening.

In still another embodiment, a garment is provided for regulating temperature, including a panel having a first surface and a second surface, and right and left side edges; at least one attachment disposed on at least one of the first and second surfaces of the section of the panel; and at least one pocket being fastened to at least one of the first and second surfaces of the panel.

DETAILED DESCRIPTION

Figure 1:
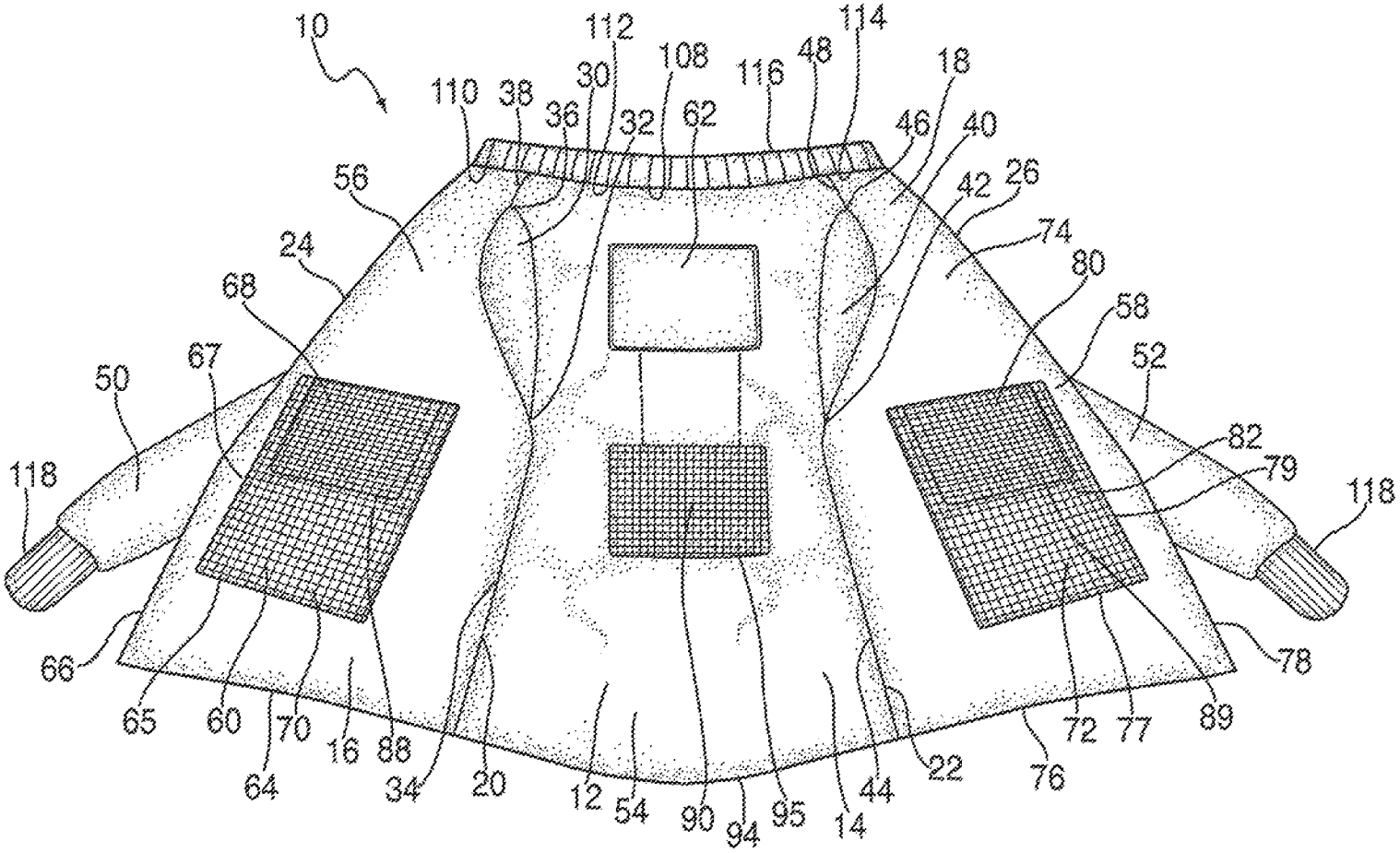
FIG. 1 is a front view of the present temperature regulating garment shown in an open position with a temperature regulating element exploded out.
Figure 2:
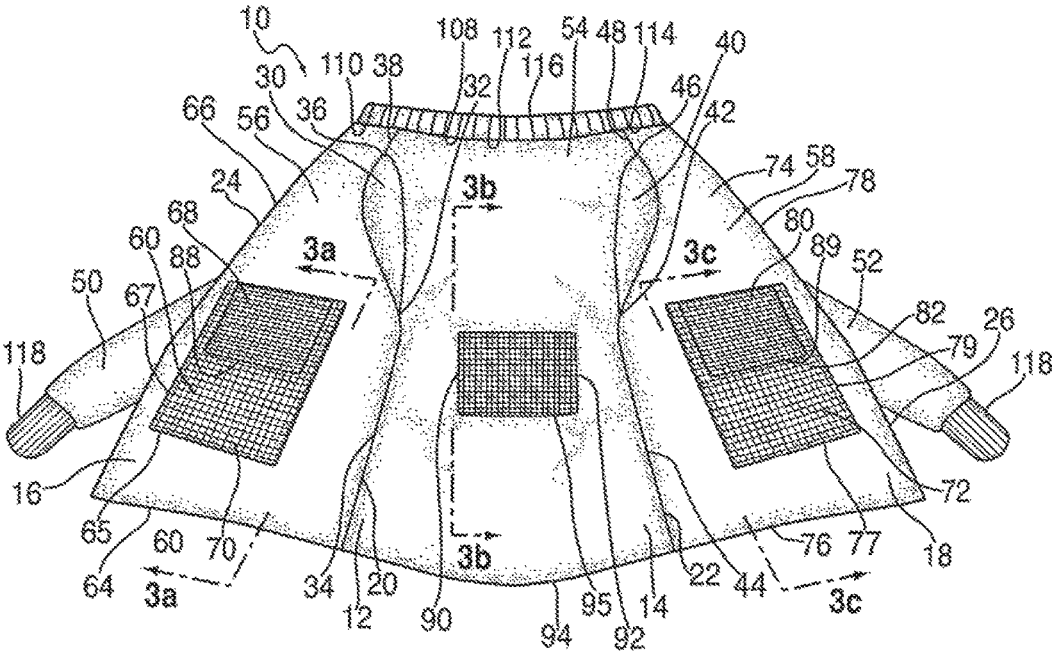
FIG. 2 is front view of the garment of FIG. 1 shown without the temperature regulating element.
Figure 4:
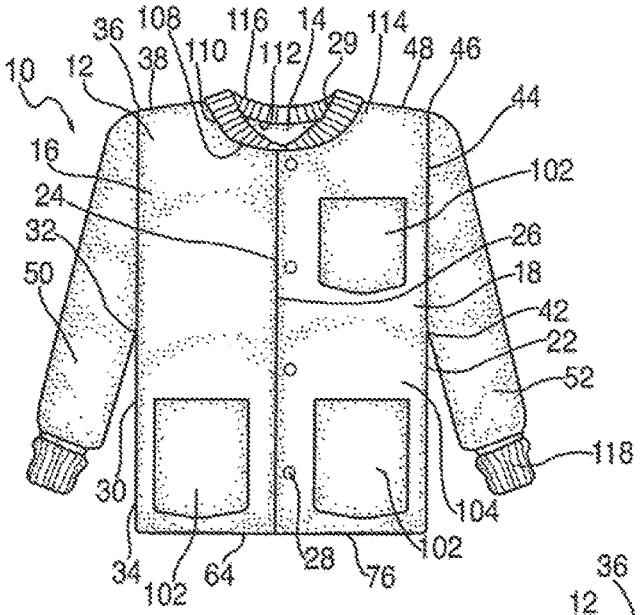
FIG. 4 is a front view of the present garment.

Referring to FIGS. 1-2 and 4, a garment for regulating temperature is generally designated 10, and in the preferred embodiment is a jacket including a body 12 with a back panel 14, at least one of a first front panel 16 and a second front panel 18. The first front panel 16 is partially joined along at least one first common edge 20 shared with the back panel 14. Likewise, the second front panel 18 is partially joined along at least one second common edge 22 shared with the back panel 14. As is known in the art, the common edges 20, 22 form seams. The first front panel 16 and the second front panel 18 are joinable along respective free edges 24, 26, preferably by fasteners 28, such as snaps, buttons, clips, zippers, VELCRO® hook and loop fastener material, and the like. Upon assembly, the joined panels 14, 16 and 18 combine to define an inside chamber 29.

A first arm hole 30 is defined in part by an end 32 of a seam 34 formed by joining the common edges 20 of the first front panel 16 and the back panel 14, and at an end 36 of the arm hole opposite the end 32 by a shoulder seam 38 formed by a junction of the first front panel 16 and the back panel 14. Likewise, a second arm hole 40 is defined by an end 42 of a second seam 44 formed by joining the common edges 22 of the second front panel 18 and the back panel 14, and at an end 46 of the arm hole 40 opposite the end 42 by a shoulder seam 48 formed by a junction of the second front panel 18 and the back panel 14.

A first sleeve 50 and a second sleeve 52 are optionally affixed respectively to the first and second arm holes 30, 40. Preferably, the body 12, and if provided, the sleeves, 50, 52 of the garment 10 are made of GORE® surgical fabric, level 3 or 4, but alternate embodiments are contemplated where the body is made of at least one layer of any thermally insulating, synthetic, non-linting medically acceptable textile, including, but not limited to polyester fabric, cotton polyester fabric, surgical fabric, nylon or the like.

Referring now to FIG. 1, the garment 10 is depicted in an open position such that an inner surface 54 of the back panel 14, an inner surface 56 of the first front panel 16, and an inner surface 58 of the second front panel 18 are shown. A first pocket 60 dimensioned for accommodating a temperature regulating element 62 is fastened to the inner or interior surface 56 of the first front panel 16 approximately 10-15 centimeters from a bottom edge or hem 64 of the first front panel to a bottom edge 65 of the pocket and approximately 4 centimeters from a side edge 66 of the first front panel 16 to an adjacent pocket edge 67. A third pocket 68, preferably smaller than the first pocket 60, is fastened to an outer or exterior surface 70 of the first pocket 60. As an alternative, the third pocket 68, is directly fastened to the inner surface 56 of the first front panel 16, and therefore lies inside the first pocket 60.

Likewise, a second pocket 72 dimensioned for accommodating the temperature regulating element 62 is fastened to an inner surface 58 of the second front panel 18 approximately 10-15 centimeters from a bottom edge or hem 76 of the second front panel 18 to a bottom pocket edge 77 and approximately 4 centimeters from a side edge 78 of the second front panel 18 to an adjacent pocket edge 79. A fourth pocket 80, preferably smaller than the second pocket 72, is fastened to an outer or exterior surface 82 of the second pocket 72. As an alternative, a fourth pocket 80, is directly fastened to the inner surface 58 of the second front panel 18, and therefore lies inside the second pocket 72.

The preferred dimension of the first and the second pockets 60, 72 is 25 cm deep or tall, and 20 cm wide. These pockets 60, 72 are sized to accommodate a larger temperature regulating element 62, including but not limited to IV fluid bags, but may also hold a smaller temperature regulating element such as a chemical warming pack. The preferred dimensions of the third and fourth pockets 68, 80 are 12 cm deep or tall and 16 cm wide. The bottom edge 65 of the first pocket 60 and the bottom edge 77 of the second pocket 72 are preferably located 13 cm from bottom edges 88, 89 of the third and fourth pockets 68, 80, respectively. These pockets 68, 80 are sized to accommodate a smaller temperature regulating element 62, such as a chemical warming pack. For the purposes of this application, the above-identified combinations of the first and third pockets 60 and 68, and the second and fourth pockets 72 and 80 will also be referred to as double pockets.

Referring now to FIG. 2, a fifth pocket 90 and a sixth pocket 92 for accommodating a temperature regulating element 62 are fastened to the inner surface 54 of the back panel 14 approximately 20-25 cm from a bottom edge 94 of the back panel to a bottom edge 95 of the pockets. Advantageously, the fifth and sixth pockets 90, 92 are placed over a wearer's lumbar region to direct the temperature regulating element 62 over this body region. Accordingly, the preferred dimension of each of the fifth and sixth pockets 90, 92 is 12-25 cm deep or tall and 16-20 cm wide. In the preferred embodiment, as seen in FIG. 2, the pockets 90 and 92 are separated by a seam 96. In FIG. 1, the seam 96 is omitted, leaving only a single pocket 90.

It is contemplated that at least one of the pockets 60, 68, 72, 80, 90 and 92 may have one of the temperature regulating elements 62 disposed inside of them at any given time. The location, dimensions, and design of the pockets 60, 68, 72, 80, 90 and 92 may vary from the above description to suit the application, provided that the pockets are constructed and arranged for allowing the heat or cooling from the temperature regulating element 62 to escape into the interior chamber 29 and this chamber is thus maintained at a desired temperature and is insulated from ambient temperature in the room, usually an operating room. Thus, the user will employ the type of temperature regulating element (s) 62 as needed to achieve a desired temperature within the interior chamber that has a perceived differential from the ambient temperature of the room. It is to be understood that this desired temperature varies with the individual and the circumstances of the application.

The garment 10 is preferably made of a non-linting, temperature insulating textile which can withstand multiple industrial or hospital launderings. Advantageously, the preferred material maintains the temperature within the inside chamber 29. In the preferred embodiment, the pockets 60, 72, 68, 80, 90, and 92 of the garment 10 are made of polyester fabric, preferably mesh which allows for enhanced conductivity of the desired temperature in the inside chamber 29. However, in other embodiments, the pockets 60, 72, 68, 80, 90, 92, can be made of other textiles. The pockets 60, 72, 68, 80, 90, 92, are fastened to the garment 10 to withstand the weight of a one liter bag of IV fluid as well as repeated use of the pockets. In the preferred embodiment, the pockets 60, 72, 68, 80, 90, 92, are sewn to the inner or interior surfaces 56, 58, 54, respectively, of the front first panel 16, the second front panel 18, and the back panel 14, although alternate ways of fastening the pockets to the front first panel, the second front panel, and the back panel are envisioned.

In the preferred embodiment, the temperature regulating element 62 is a heating element, such as a battery powered heating element, a chemical warming pack, warmed up bag of IV fluid or other elements that are remotely heated and placed into the pockets 60, 72, 68, 80, 90, 92, while warm. Advantageously, including a heating element allows the user to remain at a comfortable temperature while working in a cold operating room. In other embodiments, similar benefits are obtained when the temperature regulating element 62 is a cooling element, including elements that are remotely cooled, chemical cooling packs, refrigerated bags of IV fluid or ice packs. The placement of, and amounts of the temperature regulating element 62 can be individualized to the needs of the wearer. One skilled in the art will appreciate that the temperature regulating element 62 is not limited to those listed and can be substituted with similar temperature regulating elements.

Figure 3A:
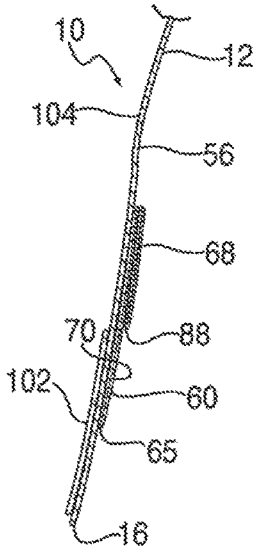
FIG. 3*a* is a cross-section taken along the line 3*a*-3*a* of FIG. 2 and in the direction generally indicated.
Figure 3B:
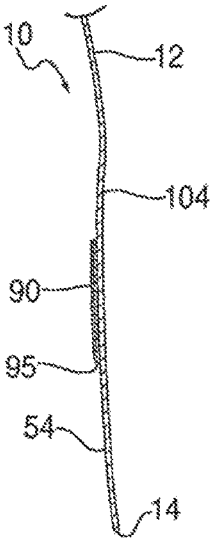
FIG. 3*b* is a cross-section taken along the line 3*b*-3*b* of FIG. 2 and in the direction generally indicated.
Figure 3C:
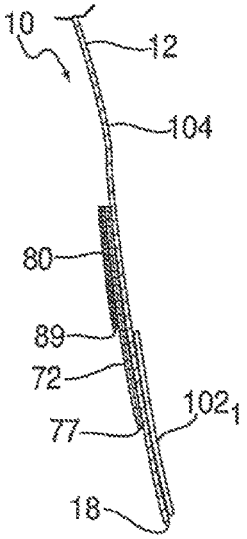
FIG. 3*c* is a cross-section taken along the line 3*c*-3*c* of FIG. 1 and in the direction generally indicated.

Referring now to FIGS. 3*a*, 3*c* and 4, at least one supplemental pocket 102 is fastened to an outer or exterior surface 104 of either or both of the first and second front panels 16, 18. As is known in the art, such supplemental pockets 102 can be used to hold a pen, pencil or other instrument needed by the wearer.

Figure 5:
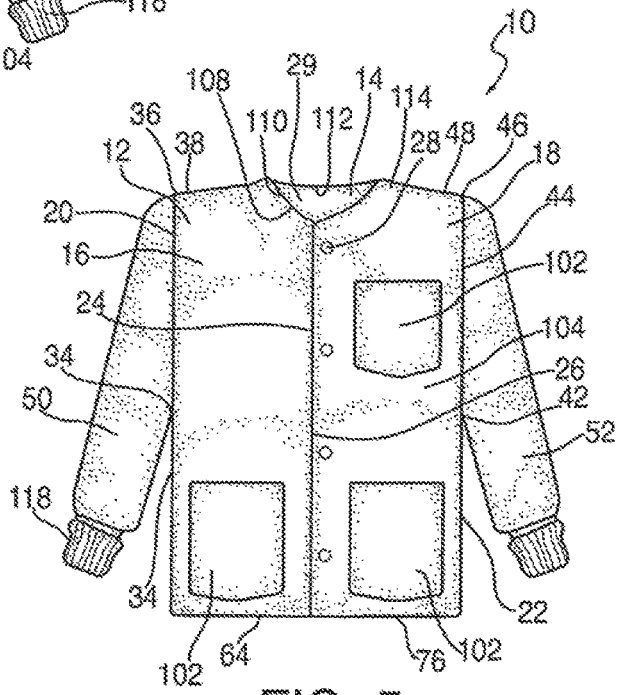
FIG. 5 is a front view of an alternate embodiment of the garment of FIG. 4.

Referring now to FIGS. 1, 2, and 4 the garment 10 preferably has a neck 108, formed by a top edge 110 of the first front panel 16, a top edge 112 of the back panel 14, and a top edge 114 of the second front panel 18. In the preferred embodiment, a collar 116, which will keep the wearer's neck warm, is affixed to the neck 108 of the garment 10. The garment 10 also preferably includes a cuff 118 affixed to each of the sleeves 50, 52. Note that the collar 116 is optional (FIG. 5). Advantageously, the cuffs 118 will keep the wrists of the wearer warm, and will serve to prevent heat from escaping into the room. The collar 116 and the cuffs 118 are preferably made of rib knit polyester, however other materials are contemplated.

Figure 6:
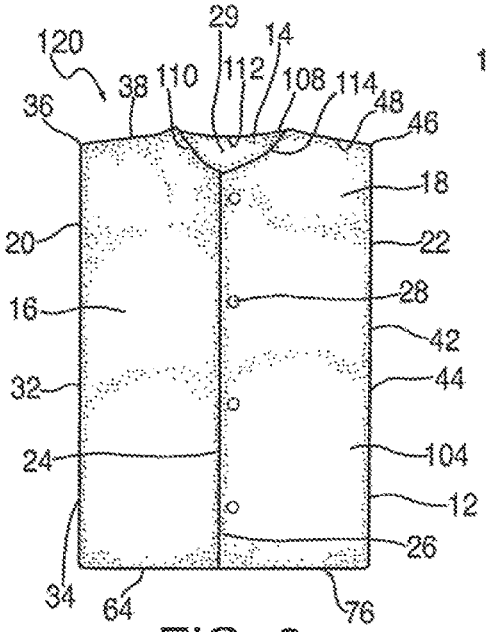
FIG. 6 is a front view of another alternate embodiment of the garment of FIG. 4.

Referring now to FIG. 6, an alternate embodiment of the garment is shown, generally designated 120. Components shared with the garment 10 are designated with identical reference numbers. The main distinction of the garment 120 is it does not have the first and second sleeves 50, 52. This embodiment is advantageous in that it helps keep the wearer's core warm or cool while being worn under a conventional warm up jacket or surgical gown. The garment 120 shown in FIG. 6 is preferably reversible such that the respective inner surfaces 56, 58, of the first 16 and second 18 front panels become an outer or exterior surface of the first 16 and second 18 front panels, respectively, and the inner surface 54 of the back panel 14 becomes an outer or exterior surface of the back panel 14. Reversing the garment 120 will place a non-fenestrated layer of material, that being the material of the body 12, between the wearer's skin and the temperature regulating element 62, particularly important if 62 is a cooling element. A temperature regulating element 62 for maintaining temperature range within the chamber between the vest and a conventional warm up jacket or between the vest and a surgical gown can be disposed into one or more pockets 60, 72, 68, 80, 90, and 92.

Furthermore, the garments 10 and 120 are designed to meet guidelines for garments worn in hospital operating rooms as set forth by the American Association of PeriOperative Registered Nurses (AORN).

Figure 7:
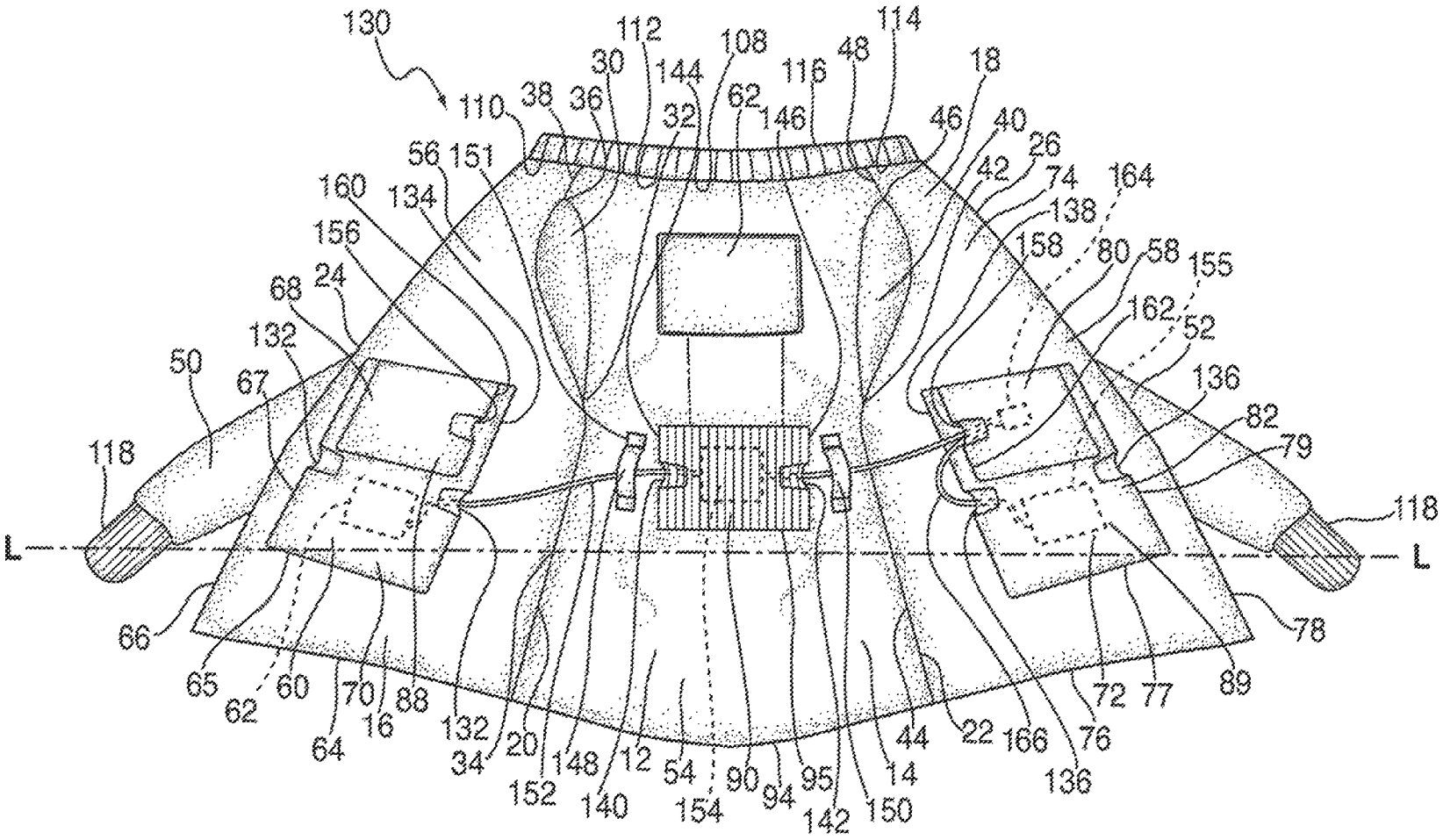
FIG. 7 is a front view of another alternate embodiment shown in an open position with a temperature regulating element exploded out.

Referring now to FIG. 7, an alternate embodiment of the garment is shown, generally designated 130. Components shared with the garment 10 are designated with identical reference numbers. The main distinction of the garment 130, compared to the garments described above, is that the attachments of at least one of the pockets 60, 72, 90 to the back, first front, and second front panels 14, 16, 18, or the attachments of at least one of the pockets 68 and 80 to the pockets 60 and 72 have openings to facilitate the placement of at least one temperature regulating element connected by at least one wire and for the attached wires to have a neat appearance and to reduce tangling of the wires. Ultimately, the wires are connected to a battery pack for generating the desired heating or cooling.

In a preferred embodiment, openings 132 are preferably centered on edges 134 and 67 of the first pocket 60 facing the fifth pocket 90. In the preferred embodiment, each opening 132 is between 2-2.5 inches long. Similar openings 136 are preferably provided on edges 138 and 79 of the second pocket 72 facing the fifth pocket 90. The fifth pocket 90 has openings 140 and 142 preferably centered on edges 144 and 146. The openings 140 and 142 are also preferably 2-2.5 inches long. Preferably, the size of the openings 132, 136, 140, and 142 are smaller than a shortest size of the temperature regulating element 62 to prevent the temperature regulating element from falling through the openings regardless of its direction in the pockets. It is contemplated that the size and location of the openings 132, 136, 140, and 142 may vary to suit the application.

Preferably, there additionally are strap-like attachments 148, 150 with at least one end removably attached to the inner surfaces 54, 56, 58. In the preferred embodiment, the attachments 148, 150 are attached to the inner surface 54 of the back panel 14. These removable attachments 148, 150 keep a connecting wire 152 connecting the respective heating elements 62 from hanging freely. The removable attachments 148, 150 are fastened to the inner surface 54 of the back panel 14 with fasteners 151 located at at least one of the top and bottom of each of the removable attachments 148, 150. In the preferred embodiment, the removable attachments 148, 150 are detachable with a fastener 151 at one end, and permanently attached on the end opposite to the end with the fastener 151. These fasteners include, but are not limited to, VELCRO® hook-and-loop fasteners, snaps, or buttons.

The removable attachments 148, 150, when fastened to the inner surface 54 of the back panel 14, define a passage for receiving the wires 152 from the temperature regulating elements 62, 154, 155 when the wires are threaded or passed from pockets 60 to 90 to 72 or alternatively 72 to 90 to 60. The removable attachments 148, 150 are removably attached to the inner surface 54 of the back panel 14, respectively between the first pocket 60 and the fifth pocket 90 and between the second pocket 72 and the fifth pocket 90. However, other attachment technologies and arrangements of the removable attachments are contemplated. It is also contemplated that in some embodiments, both ends of the attachments 148, 150 are fixed to the inner surface 54.

The openings 132, 136, 140, 142 are dimensioned to accommodate a folded temperature regulating element 62, or the like, which is connected via the wire or cord 152, to a second temperature regulating element 154 (shown hidden) located in one of the other pockets. Once inserted through the openings 132, 136, 140, 142, the temperature regulating element 62 is unfolded by the user so that it remains in the pocket. At the same time, the wire 152 maintains connection to the second temperature regulating element 154. Preferably, pockets 60, 72, and 90 are conventional, open-topped pockets, and can be either single or double pockets as discussed above.

Thus, a user can thread or pass the connected first temperature regulating element 62, second temperature regulating element 154, and third temperature regulating element 155 and wires 152 into the designated pockets without needing to disconnect any of the elements for separate placement in pockets. For example, the user first passes a third temperature regulating element 155 (shown hidden) sequentially through openings 140 and 142 of the fifth pocket 90 and then through opening 136 in the pocket 72. The second temperature regulating element 154, connected by wire 152, is passed through the opening 140 of the fifth pocket 90, and the temperature regulating element 62 is inserted into the first pocket 60 through the opening 132. Preferably, the removable attachments 148, 150 are unattached during the passing process, and fastened with fasteners 151 after elements 62, 154, and 155 are disposed in pockets 60, 90, and 72. Alternatively, the removable attachments 148, 150 are attached during the passing process, and each element 62, 154, 155 can be passed through the passage defined by the removable attachments.

In a preferred embodiment, in general, the pockets 60, 90 and 72, and more specifically, the openings 132, 136, 140, and 142 are generally aligned, and are disposed along a common latitudinal axis L. In the preferred embodiment, the removable attachments 148, 150 are also generally in alignment with openings 140, and 142, and in some cases also openings 132, 136. The removable attachments 148, 150 are preferably disposed along a common latitudinal axis 'L' such that the attachments are fastened with fasteners 151 disposed on either side of the axis L. Therefore, when elements 62, 154, and 155 are disposed in pockets 60, 90, and 72, the wire 152 preferably is level and parallel to axis L.

The third pocket 68 and fourth pocket 80 preferably have openings 156 and 158 on edges 160 and 162, each facing the fifth pocket 90. In a preferred embodiment, openings 156 and 158 are two inches in length and centered on edges 160 and 162. Preferably, pockets 68 and 80 are conventional, open-topped pockets. As is the case with the openings 132, 136, 140, 142, the length and position of the openings 156, 158 may vary to suit the application.

In a preferred embodiment, temperature regulating elements 62, 154, and 155 are connected to an associated battery pack 164 (shown hidden). The battery pack 164 is contemplated as being of any one of a commercially available style, including rechargeable removable batteries, rechargeable fixed batteries, being disposable as a unit, or the like. Preferably, while the temperature regulating elements 62, 154, 155 are passed through pockets 60, 90, and 72, the battery pack 164 is disconnected from the temperature regulating elements. Preferably, the battery pack 164 is placed in the pockets 68 or 80 conventionally through open tops of the pockets 68 or 80. Alternatively, it is contemplated that the battery pack 164 is placed in the pockets 68 or 80 through openings 156 or 158. It is also contemplated that the battery pack 164 is located in one of the other pockets that also houses a temperature regulating element. Once the temperature regulating elements 62, 154, 155 are disposed in the pockets 60, 90, and 72, the battery pack 164 is connected to the temperature regulating elements via a wire 166 and a suitable plug-in coupler (not shown). The battery pack 164 is also optionally provided with a power adjustment to enable user adjustment of the power distributed to the various temperature regulating elements 62, 154, 155.

Figure 8:
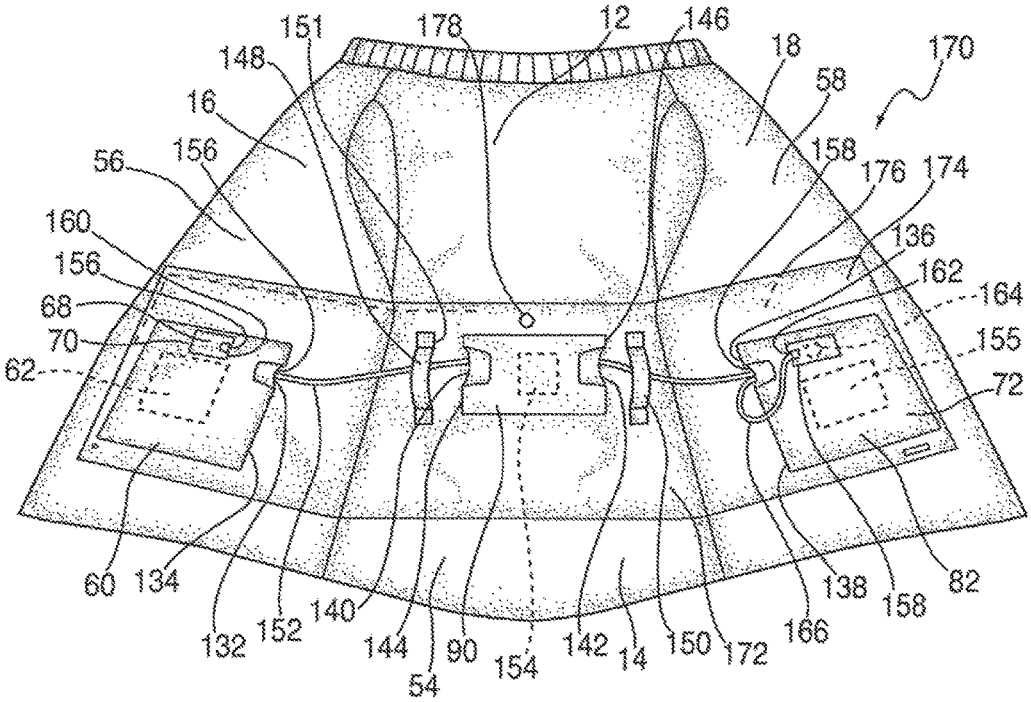
FIG. 8 is a front view of another alternate embodiment shown in an open position.
Figure 9:
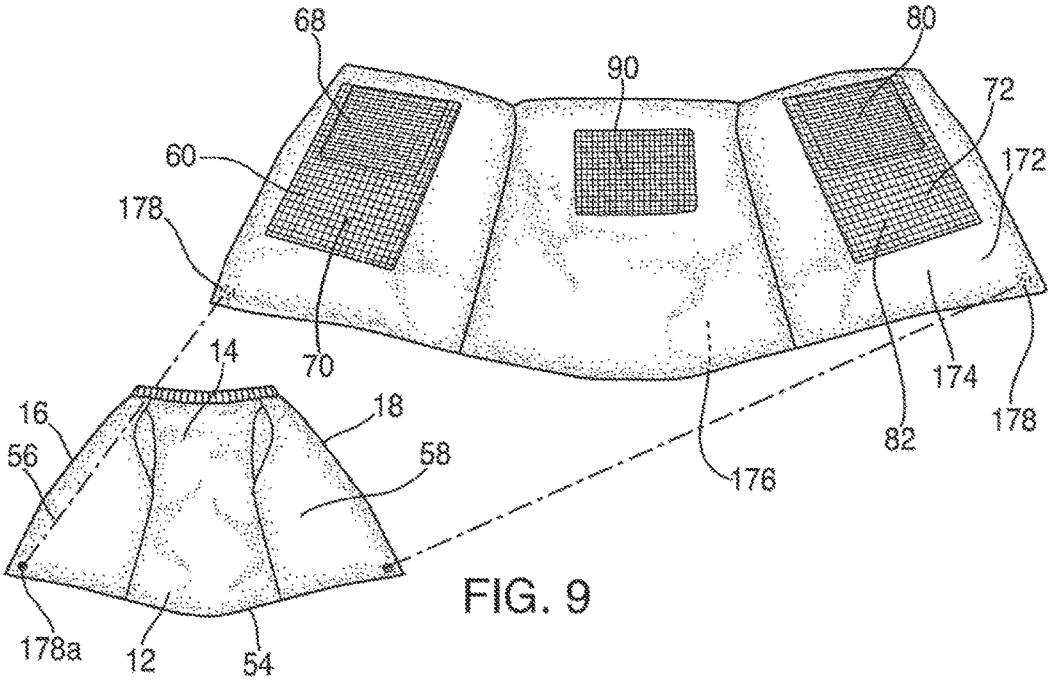
FIG. 9 is a front view of the garment of FIG. 8 shown in an open position with an inner liner panel exploded out.

Referring now to FIGS. 8 and 9, an alternate embodiment of the garment is shown, generally designated 170. Components shared with the garment 10 are designated with identical reference numbers. The main distinction of the garment 170, compared to the garments described above, is that garment 170 has an inner, preferably removable, liner panel 172 preferably fastened to the inner surfaces 56 and 58 of the front panels 16 and 18 and the inner surface 54 of the back panel 14. In a preferred embodiment, the inner liner panel 172 is attached to the inner surfaces 56 and 58 of the front panels 16 and 18 and the inner surface 54 of the back panel 14 with at least one fastener 178 and preferably several such fasteners. These fasteners are contemplated to include, but are not limited to, VELCRO® hook-and-loop fasteners, snaps, buttons, or eyelets. Preferably, the fasteners 178 are disposed along or near the perimeter of the inner liner panel 172.

Preferably, the inner liner panel 172 is made of a web of at least one layer of suitable textile, as discussed above, or any textile material, and has a first surface 174 and an opposite second surface 176. In this preferred embodiment, first, second, and fifth pockets 60, 72, and 90 are attached to the first surface 174 of the inner liner panel 172 and face away from the inner surfaces 56 and 58 of the front panels 16 and 18 and the inner surface 54 of the back panel 14. However, the pockets can readily be attached to the second surface 176, and face the inner surfaces 56 and 58 of the front panels 16 and 18 and the inner surface 54 of the back panel 14.

In the preferred embodiment, the first, second, and fifth pockets 60, 72, and 90 are attached to the first surface 174 in registry or in line with one another. It is contemplated that the inner liner panel 172 is sized to closely accommodate the preferred dimensions of the first and second pockets 60 and 72, preferably 25 cm tall. Preferably, the inner liner panel 172 is attached to the body 12 so that the fifth pocket 90 is positioned over the wearer's lumbar region.

It is contemplated that the first and second pockets 60 and 72 additionally have third pocket and fourth pockets 68 and 80. Preferably, the third pocket 68 is fastened to an outer or exterior surface 70 of the first pocket 60. However, the third pocket 68 can readily be attached to an inner or interior surface of the first pocket 60. As an alternative, the third pocket 68, is directly fastened to the first surface 174 of the inner liner panel 172, and therefore lies inside the first pocket 60. Similarly, the fourth pocket 80 is fastened to an outer or exterior surface 82 of the second pocket 72, and also can readily be attached to an inner or interior surface of the second pocket 72. As an alternative, the fourth pocket 80, is directly fastened to the first surface 174 of the inner liner panel 172, and therefore lies inside the second pocket 72.

It is contemplated that the inner liner panel 172 is made of any thermally insulating, synthetic, non-linting medically acceptable textile, including, but not limited to polyester fabric, cotton polyester fabric, surgical fabric, nylon or the like. It is also contemplated that the inner liner panel 172 is made of a non-thermally insulating textile since the inner liner panel 172 is attached to the garment 170 which is made of a thermally insulating textile. In an embodiment, the inner liner panel 172 is made of MYLAR® biaxially-oriented polyethylene terephthalate film. Besides the material, the length, width, thickness and any other dimension of the liner panel 172 may vary to suit the application.

Preferably, the first, second, and fifth pockets 60, 72, and 90 attached to the first surface 174 of the inner liner panel 172 have openings 132, 136, 140, and 142. As described with respect to FIG. 7, a user threads or passes the connected first temperature regulating element 62, second temperature regulating element 154, and third temperature regulating element 155 and wires 152 into the designated pockets without needing to disconnect any of the elements for separate placement in pockets by threading the connected elements through the openings. Preferably, the associated battery pack 164 is placed in the pockets 68 or 80 conventionally through open tops of the pockets 68 or 80. Alternatively, it is contemplated that the battery pack 164 is placed in the pockets 68 or 80 through openings 156 or 158. It is also contemplated that the battery pack 164 is located in one of the other pockets that also houses a temperature regulating element. Once the temperature regulating elements 62, 154, 155 are disposed in the pockets 60, 90, and 72, the battery pack 164 is connected to the temperature regulating elements via a wire 166 and a suitable plug-in coupler (not shown).

Preferably, there additionally are strap-like attachments 148, 150 with at least one end removably attached to the first surface 174 of the inner liner panel 172. In the preferred embodiment, the removable attachments 148, 150 are detachable with a fastener 151 at one end, and permanently attached on the end opposite to the end with the fastener 151. These fasteners 178 include, but are not limited to, VELCRO® hook-and-loop fasteners, snaps, buttons, or eyelets.

The removable attachments 148, 150, when fastened to the first surface 174 of the inner liner panel 172, define a passage for receiving the wires 152 from the temperature regulating elements 62, 154, 155 when the wires are threaded or passed from pockets 60 to 90 to 72 or alternatively 72 to 90 to 60. The removable attachments 148, 150 are removably attached to the first surface 174 of the inner liner panel 172, respectively between the first pocket 60 and the fifth pocket 90 and between the second pocket 72 and the fifth pocket 90. However, other attachment technologies and arrangements of the removable attachments 148, 150 are contemplated.

FIG. 9 shows the garment 170 of FIG. 8 with the inner liner panel 172 exploded out. In a preferred embodiment, the inner liner panel is attached to the inner surfaces 56 and 58 of the front panels 16 and 18 and the inner surface 54 of the back panel 14 with at least one fastener 178. These fasteners 178 are contemplated to include, but are not limited to, VELCRO® hook-and-loop fasteners, snaps, or buttons. Preferably, the fasteners 178 are disposed along the perimeter of the inner liner panel 172 and engage complementary fastener portions 178*a* located on the body 12.

After the jacket, vest, or garment 170 is worn by the user, the user optionally removes the entire inner liner panel 172 from the inner surfaces 56 and 58 of the front panels 16 and 18 and the inner surface 54 of the back panel 14 so that the garment 170 can be conveniently laundered. Therefore, once the temperature regulating elements 62, 154, and 155, battery pack 164, and associated wires 152 and 166 are disposed within the pockets attached to the inner liner panel 172 as described above, the user does not have to extricate the elements each time he or she would like to wash the garment 170, and then put the elements back into the pockets once the garment is washed. The temperature regulating elements 62, 154, and 155, battery pack 164, and associated wires 152 and 166 can remain in the inner liner panel 172. However, it is also contemplated that the inner liner panel 172 is optionally sewn onto the inner surfaces 56 and 58 of the front panels 16 and 18, and the inner surface 54 of the back panel 14.

Additionally, it is contemplated that because the inner liner panel 172 is a separate component from the body 12 of the garment 170, an already existing garment can be "retrofitted" with the inner liner panel 172. It is contemplated that the inner liner panel is dimensioned to retrofit into already existing garments 170 with bodies 12 of various sizes. In the preferred embodiment, the body 12 is provided with fasteners 178 that are configured for engaging the inner liner panel 172. Alternatively, the body 12 is retrofitted by stitching the inner liner panel 172 in place.

Figure 10:
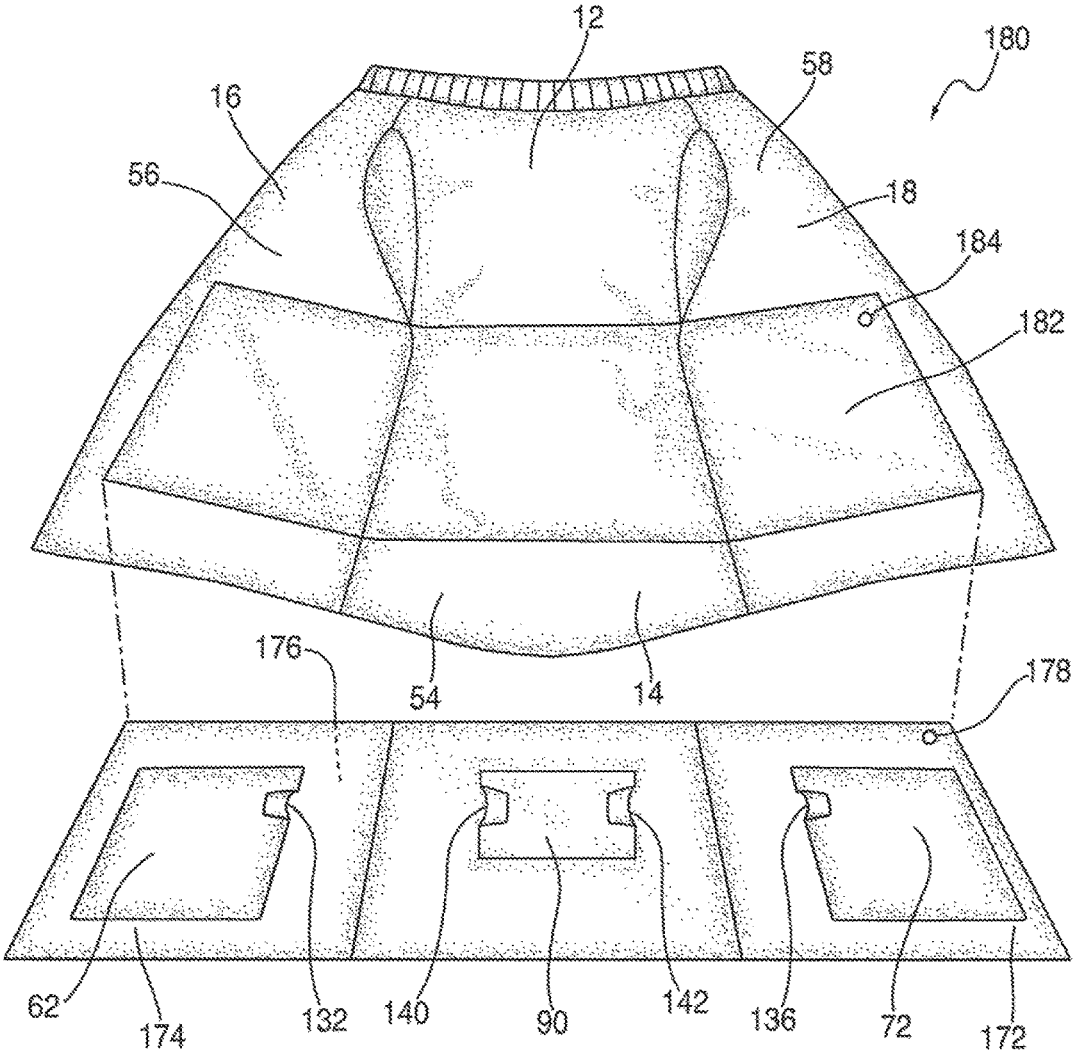
FIG. 10 is a front view of another alternate embodiment shown in an open position with an inner liner panel exploded out.

Referring now to FIG. 10, an alternate embodiment of the garment is shown, generally designated 180. Components shared with the garment 10 are designated with identical reference numbers. A main feature of the garment 180 is at least one backing strip 182 permanently attached to the inner surfaces 56 and 58 of the front panels 16 and 18 and the inner surface 54 of the back panel 14. Preferably, the backing strip 182 is permanently attached to the inner surfaces 56 and 58 of the front panels 16 and 18 and the inner surface 54 of the back panel 14 by stitching the backing strip in place. Other methods of attaching textiles are contemplated, including but not limited to fabric glue and iron-on adhesives. In this embodiment, the inner liner panel 172 is fastened to the backing strip 182 with at least one fastener 184. These fasteners 184 on the backing strip 182, like the fasteners 178*a* on the body 12 in FIG. 9, are complementary with the associated fasteners 178 on the inner liner panel 172. The contemplated suitable fasteners 184 include, but are not limited to, VELCRO® hook-and-loop fasteners, snaps, or buttons.

In the preferred embodiment, the backing strip 182 has the same dimensions as, and corresponds in size to the inner liner panel 172. However, it is also contemplated that the backing strip 182 is variable in size from the inner liner panel 172, so long as the backing strip 182 is attachable to the garment 180 and has fasteners 184 that engage the fasteners 178 on the inner liner panel 172. Preferably, the backing strip 182 is rectangular, but a multitude of shapes is contemplated, such as an X-shape. Alternatively, it is also contemplated that two or more backing strips, both with fasteners to engage the inner liner panel 172 are suitable. In a preferred embodiment, the two or more backing strips are attached to inner surfaces 56 and 58 of the front panels 16 and 18 and the inner surface 54 of the back panel 14 in a parallel formation with fasteners to engage either the top and bottom edges of the inner liner panel 172 or the side edges of the inner liner panel 172.

Figure 11:
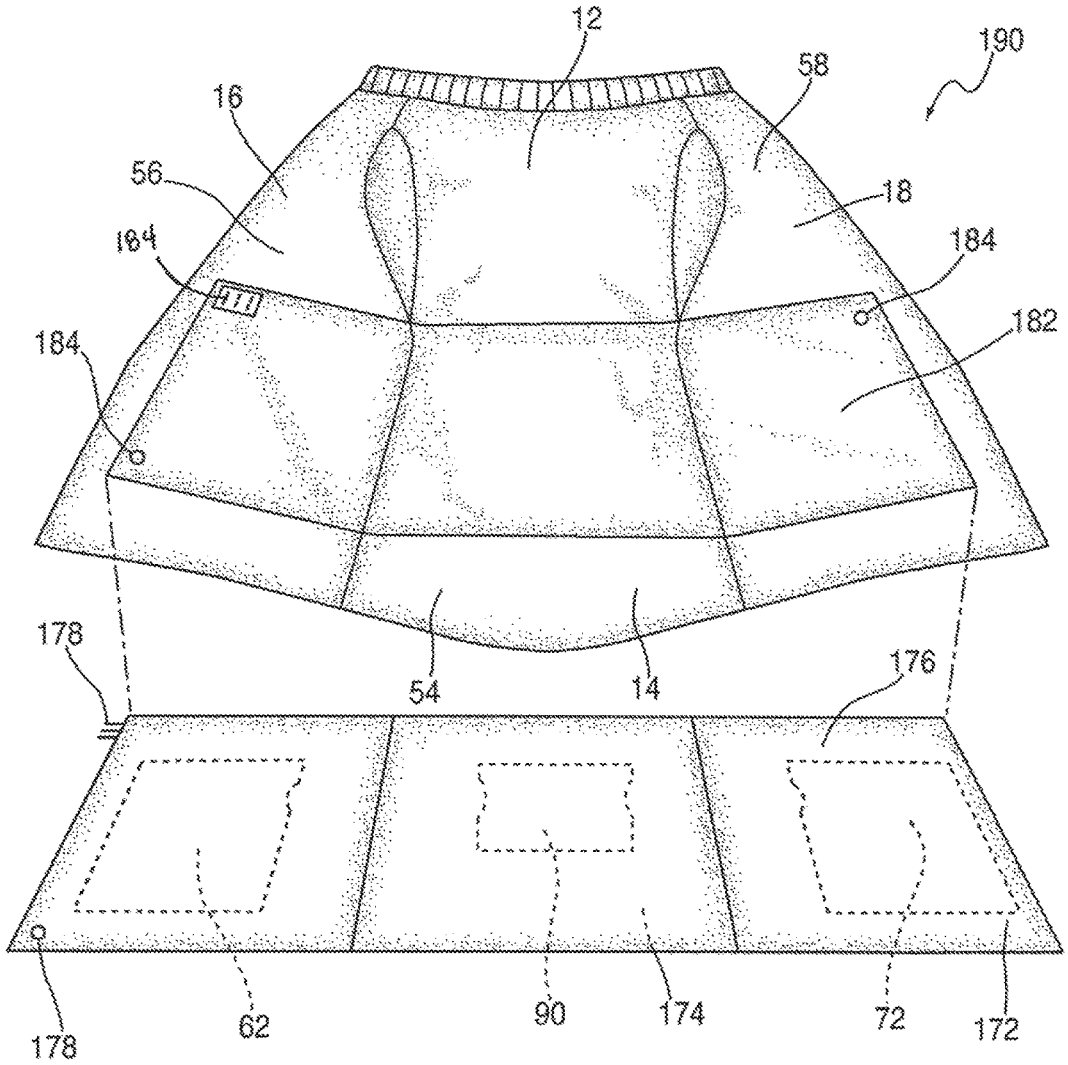
FIG. 11 is a front view of another alternate embodiment of the garment of FIG. 10 shown in an open position with an inner liner panel exploded out.

Referring now to FIG. 11, an alternate embodiment of the garment is shown, generally designated 190. Features shared with the other embodiments are designated with identical reference numbers. The main feature of the garment 190 is a backing strip 182 that engages the inner liner panel 172 (shown exploded out). The first, second, and fifth pockets 60, 72, and 90 (indicated by broken lines in FIG. 11) are attached to the second surface 176 of the inner liner panel 172.

In a preferred embodiment, both of the first and second surfaces 174 and 176 have the fasteners 178 attached in registry with each other on both surfaces such that the inner liner panel 172 is reversible. In other words, the user chooses whether the surface of the inner liner panel 172 with the first, second, and fifth pockets 60, 72, and 90 attached faces the inner surfaces 56 and 58 of the front panels 16 and 18 and the inner surface 54 of the back panel 14, or whether the surface with the pockets attached faces the user's skin.

Figure 12:
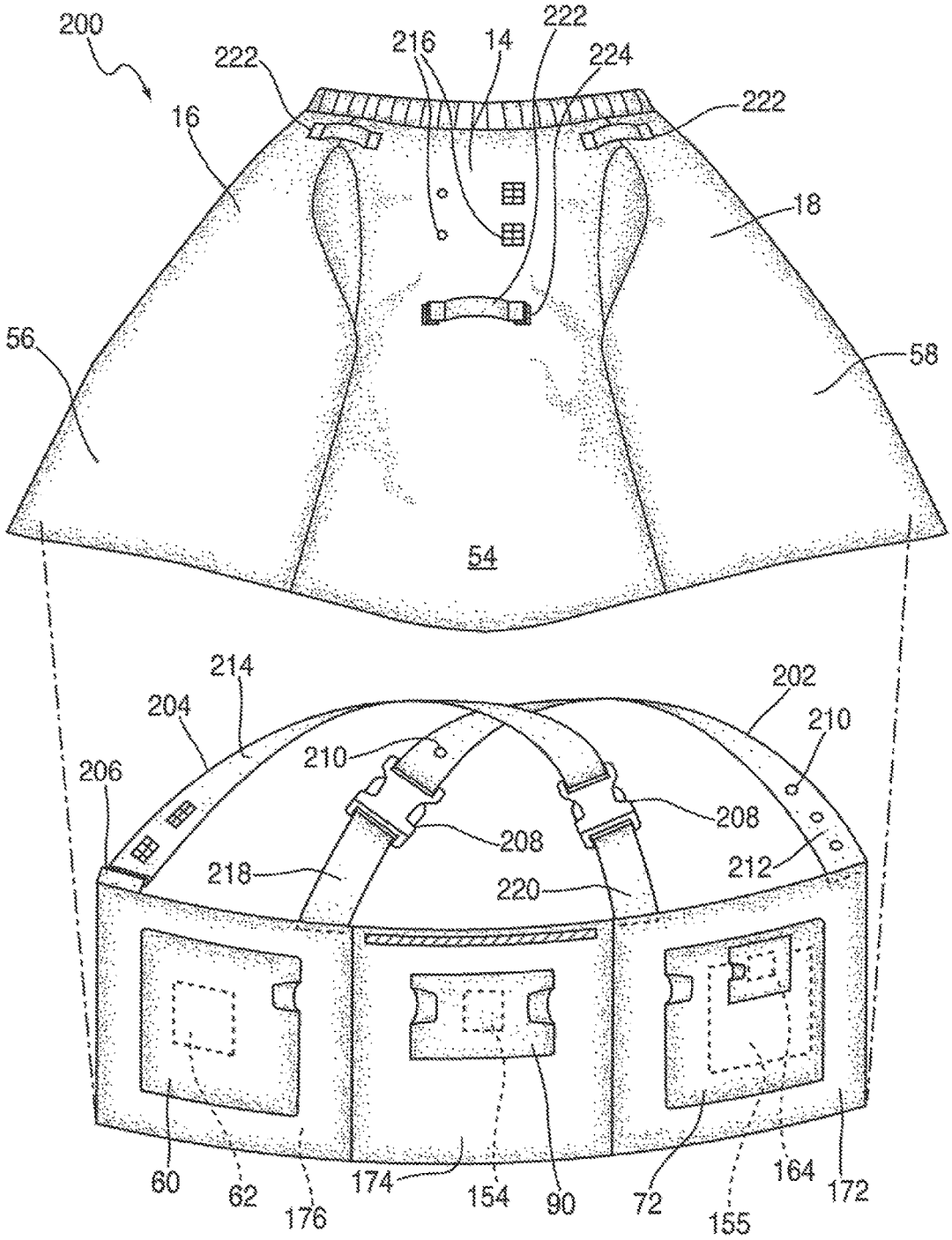
FIG. 12 is a front view of another alternate embodiment shown in an open position with an inner liner panel exploded out.
Figure 13A:
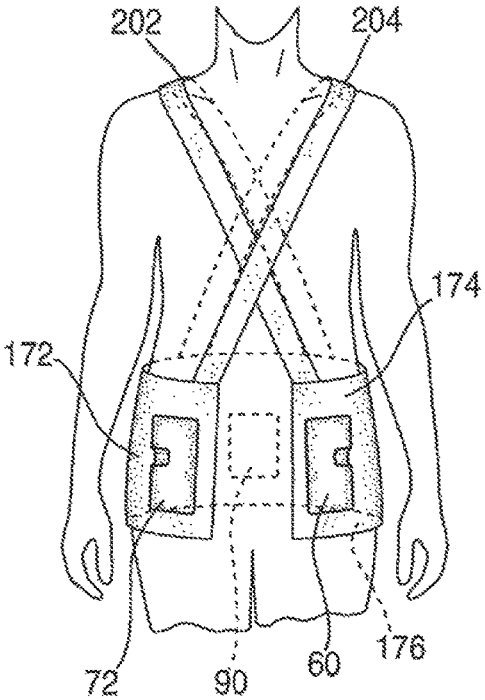
FIG. 13A-13D are front views of alternate embodiments of the inner liner panel of FIG. 12.
Figure 13B:
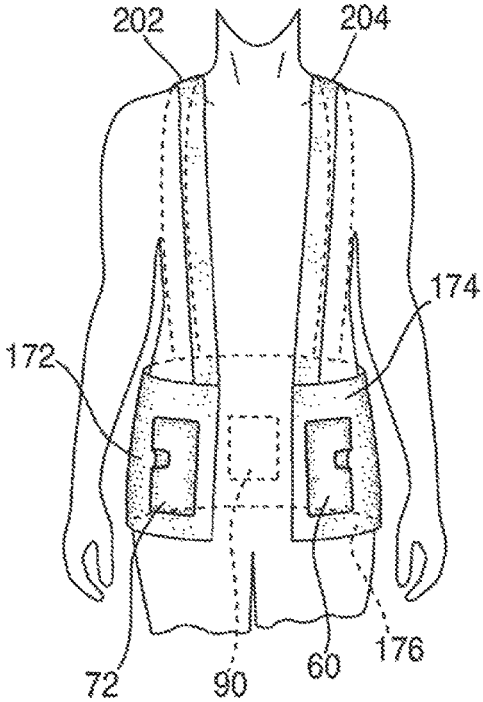
Figure 13C:
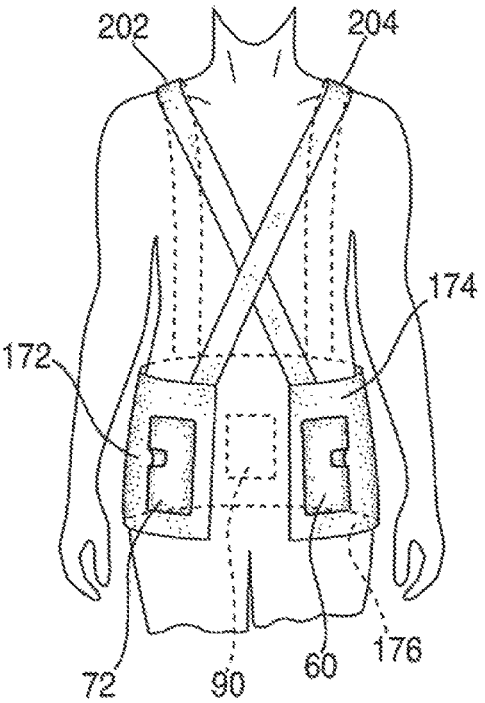
Figure 13D:
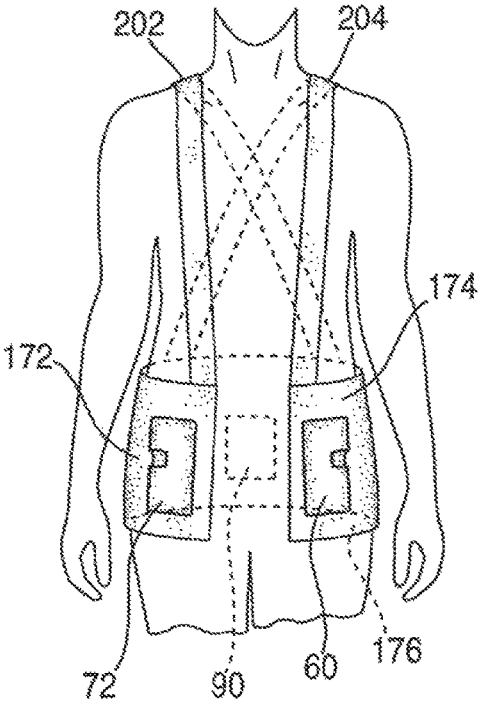
Figure 14:
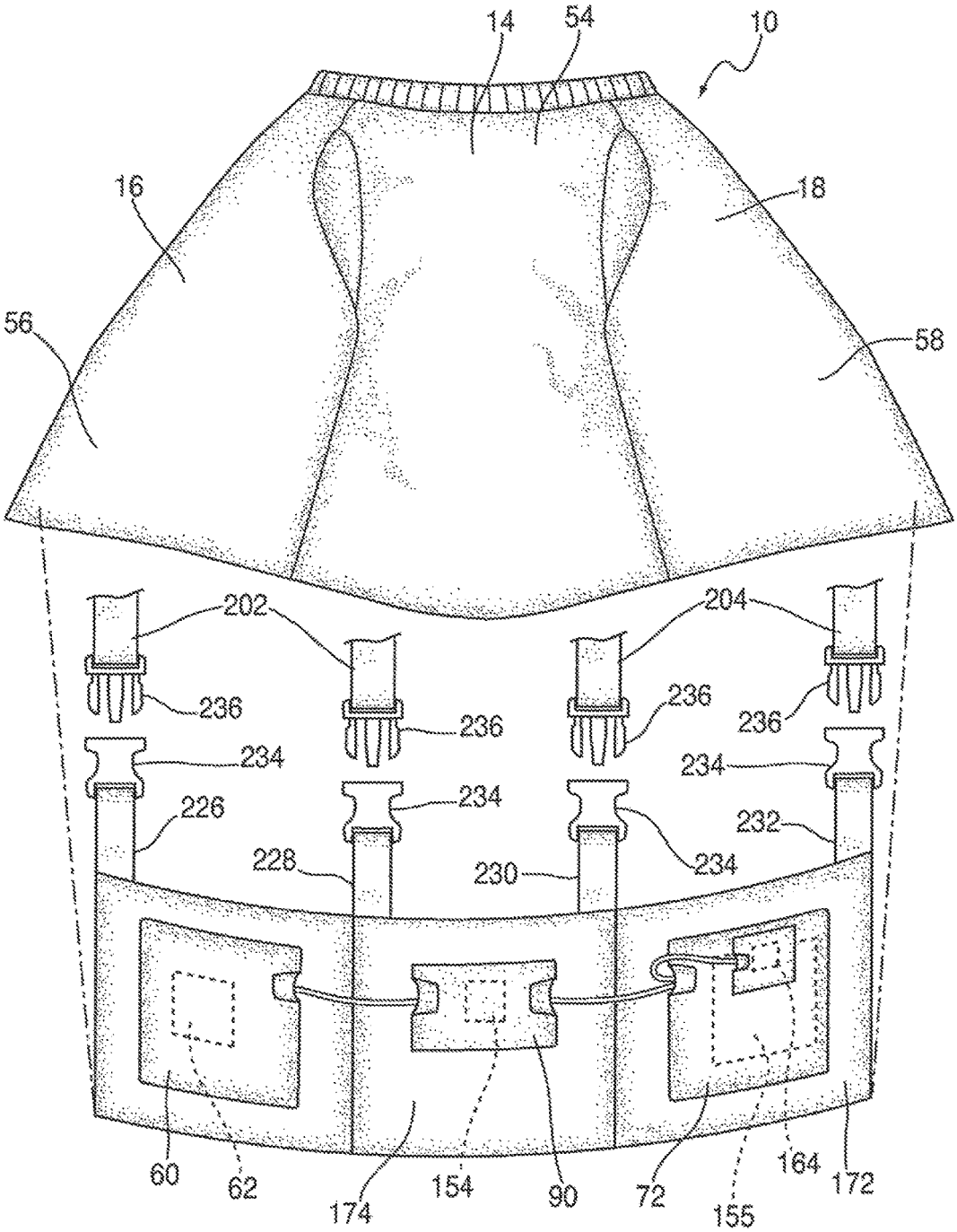
FIG. 14 is a front view of another alternate embodiment of the garment of FIG. 12 shown in an open position with an inner liner panel exploded out.

Referring now to FIGS. 12-14, an alternate embodiment of the garment is shown, generally designated 200. Components shared with the garment 10 are designated with identical reference numbers. A main feature of the garment 200 is that the inner liner panel 172 has first and second straps 202 and 204 attached to the second surface 176 of the inner liner panel 172.

FIG. 12 shows the garment 200 with the inner liner panel 172, with attached straps 202 and 204, exploded out. In the preferred embodiment, the straps 202 and 204 are made of at least one layer of a soft, durable, comfortable textile, and are sufficiently wide enough to distribute the weight of the liner panel 172, the temperature regulating elements 62, 154, and 155, and the battery 164 over a wide enough area on a user's shoulders to avoid irritation. For use in an operating room, it is preferable that the textile or material used to make the straps 202 and 204 meet guidelines for garments worn in hospital operating rooms as set forth by the AORN.

In a preferred embodiment, the first and second straps 202 and 204 are attached to the second surface 176 of the inner liner panel 172 by fasteners 206. It is contemplated that the fasteners 206 include, but are not limited to, snaps, VELCRO® hook and loop fastener, buttons, and eyelets. It is also contemplated that the straps 202 and 204 are permanently attached onto the inner liner panel 172, as by stitching, adhesives or the like.

Preferably, the straps 202 and 204 are adjustable in length, allowing the user to adjust the length of the straps 202 and 204 for different sized wearers, and also to allow the wearer to adjust the straps 202 and 204 to dispose the temperature regulating elements 62, 154, and 155 in a comfortable location on the wearer's body. In a preferred embodiment, the straps 202 and 204 have releasable couplings 208. The releasable couplings 208 include, but are not limited to, plastic or metal side release buckles, VELCRO® hook and loop fastener, snaps, buttons, D- or O-rings and snap hooks, and grommets or eyelets and snap hooks. The releasable couplings 208 segment portions of the straps 202 and 204 such that the segmented straps 202 and 204 are releasably joined by the couplings. When a user wants to release the straps 202 and 204 and the attached inner liner panel 172, the user applies pressure to both sides of the buckle or other coupling to release the straps 202 and 204.

In the preferred embodiment, the straps 202 and 204 are attached to the inner surfaces 56 and 58 of the front panels 16 and 18 and the inner surface 54 of the back panel 14 with fasteners 210 disposed on a first surface 212 of the strap 202, and on a first surface 214 of the strap 204. Complementary fasteners 216 are disposed in corresponding locations on the inner surfaces 56 and 58 of the front panels 16 and 18 and the inner surface 54 of the back panel 14. The fasteners 210 and 216 include, but are not limited to, VELCRO® hook-and-loop fasteners, snaps, buttons and eyelets. It is contemplated that the fasteners 210 are readily disposed on a second surface 218 of the strap 202, and on a second surface 220 of the strap 204. Further, it is also contemplated that the fasteners 210 are disposed on both surfaces of the straps, such that the inner liner panel 172 and attached strap assembly is reversible.

Alternatively, there are loops 222 attached to the inner surfaces 56 and 58 of the front panels 16 and 18, and the inner surface 54 of the back panel 14 for the straps 202 and 204 to thread or pass through. Preferably, one end of the loops 222 is removably attached to the inner surfaces 56 and 58 of the front panels 16 and 18, and the inner surface 54 of the back panel 14 with fasteners 224. The fasteners 224 include, but are not limited at, VELCRO® hook-and-loop fasteners, snaps, or buttons. Additionally, it is contemplated that the loops 222 are permanently stitched or otherwise fastened at both ends into the inner surfaces 56 and 58 of the front panels 16 and 18, and the inner surface 54 of the back panel 14.

In an embodiment, the straps 202 and 204 and inner liner panel 172 are not attached in any way to the inner surfaces 56 and 58 of the front panels 16 and 18, and the inner surface 54 of the back panel 14, and the straps 202 and 204 rest on the shoulders of the wearer without being attached to the garment. This allows the liner panel 172 and attached straps 202 and 204 to be worn with any already available garment, and does not require modification of the garment.

FIGS. 13A-13D show four contemplated configurations for the straps 202 and 204. FIG. 13A shows the strap 202 attached at two locations on the second surface 176 of the inner liner panel 172, and resting on the wearer's right shoulder. Likewise, the strap 204 is attached at two locations on the second surface 176 of the inner liner panel 172, and rests on the wearer's left shoulder. The straps 202 and 204 cross each other on both the wearer's chest and back. Preferably, the second surface 176 of the inner liner panel 172 faces towards the wearer, and the first surface 174 with pockets 60, 72, and 90 attached faces outwardly. However, it is contemplated that the straps 202 and 204 are attached on the first surface 174 of the inner liner panel 172. Further, it is also contemplated that the surface with pockets 60, 72, and 90 attached faces towards the wearer.

FIG. 13B shows the strap 202 attached at two locations on the second surface 176 of the inner liner panel 172, and resting on the wearer's right shoulder. Likewise, the strap 204 is attached at two locations on the second surface 176 of the inner liner panel 172, and rests on the wearer's left shoulder. However, in this version, the straps 202 and 204 do not cross at all.

FIG. 13C shows the strap 202 attached at two locations on the second surface 176 of the inner liner panel 172, and resting on the wearer's right shoulder. Likewise, the strap 204 is attached at two locations on the second surface 176 of the inner liner panel 172, and rests on the wearer's left shoulder. The straps 202 and 204 cross each other on the wearer's chest, but not the wearer's back.

FIG. 13D shows the strap 202 attached at two locations on the second surface 176 of the inner liner panel 172, and resting on the wearer's right shoulder. Likewise, the strap 204 is attached at two locations on the second surface 176 of the inner liner panel 172, and rests on the wearer's left shoulder. The straps 202 and 204 cross each other on the wearer's back, but not the wearer's front. While these strap configurations have been shown and described in conjunction with FIGS. 13A-13D, other strap configurations and attachments are contemplated.

FIG. 14 shows the inner liner panel 172 with four attachment straps 226, 228, 230, and 232 attached to the second surface 176 of the inner liner panel 172 at four locations. In the preferred embodiment, the attachment straps 226, 228, 230, and 232 each have plastic connectors 234, such as side release buckles disposed at the ends of the attachment straps. Preferably, the straps 202 and 204 have connectors 236 disposed at both ends of the straps 202 and 204. The connectors 236 are complementary to all of the connectors 234 disposed at the ends of the attachment straps 226, 228, 230, and 232. Therefore, it is contemplated that the straps 202 and 204 are readily connected to the attachment straps 226, 228, 230, and 232 in the configurations shown and described in FIGS. 13A-13D. Additionally, other strap configurations and connections are contemplated.

It is also contemplated that the straps 202 and 204 are attached to the inner liner panel 172 with a long strip of VELCRO® hook and loop fastener material disposed on the second surface 176 of the inner liner panel 172. Preferably, therefore, the straps 202 and 204 are readily connected to the VELCRO® hook and loop fastener material on the second surface 176 of the inner liner panel 172 in the configurations shown and described in conjunction with FIGS. 13A-13D. Additionally, other strap configurations and connections are contemplated. It is also contemplated that straps 202 and 204 are readily attached to the first surface 174 of the inner liner panel 172.

Figure 15:
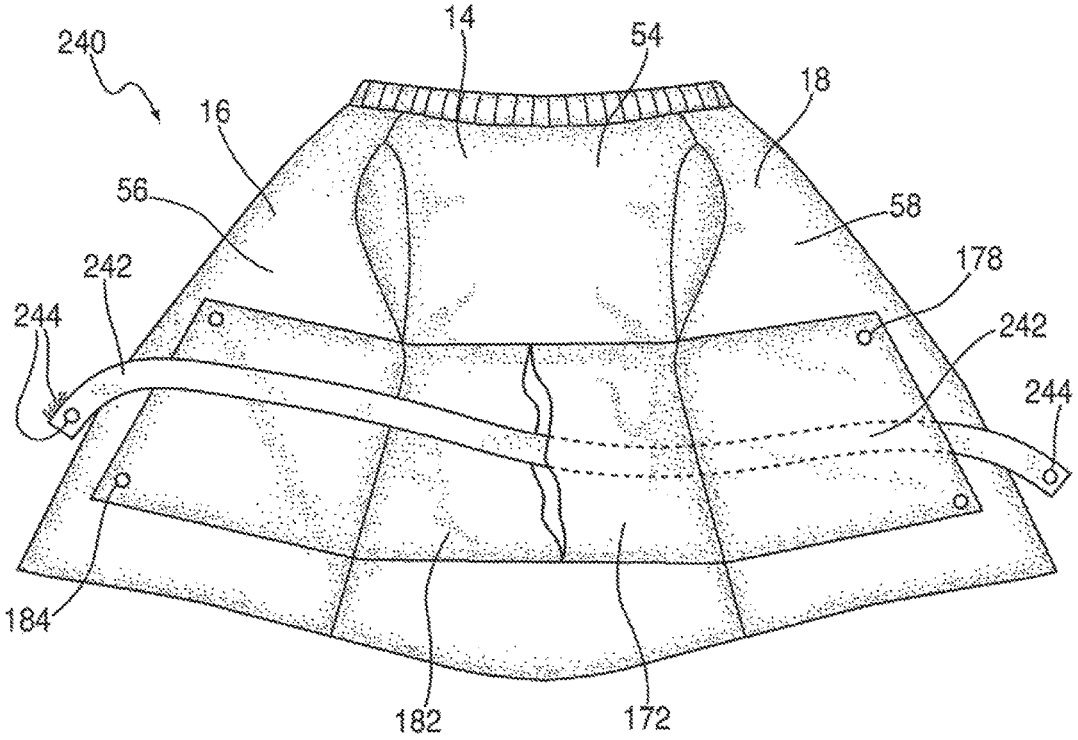
FIG. 15 is a front view of another alternate embodiment shown in an open position.

Referring now to FIG. 15-16, another alternate embodiment of the garment is shown, generally designated 240. Components shared with the garment 10 are designated with identical reference numbers. A main feature of the garment 240 is that the inner liner panel 172 has a strap 242, preferably adjustable, attached, allowing a user to wear the inner liner panel 172 and the attached strap 242 in a belt-like manner around the wearer's waist. In this embodiment, the inner liner panel 172 is a separate component from the garment 240.

As shown in FIG. 15, the strap 242 is preferably passed between the backing strip 182 and the inner liner panel 172, through the opening between where the backing strip 182 and the inner liner panel 172 are fastened by complementary fasteners 178 and 184.

Preferably, the strap 242 is made of an elastic material, with complementary connectors 244 disposed at each end of the strap 242. The set of complementary connectors 244 include, but are not limited to, VELCRO® hook-and-loop fasteners, buckles, buttons, snaps, and eyelets. Additionally, it is contemplated that the strap 242 is made of any soft, comfortable textile.

Figure 16A:
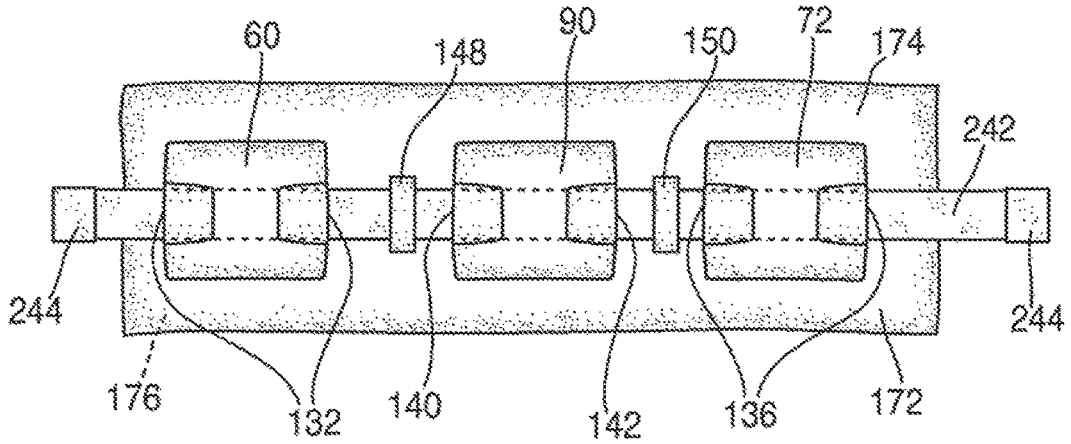
FIG. 16A-16C are front views of alternate embodiments of an inner liner panel of FIG. 15.
Figure 16B:
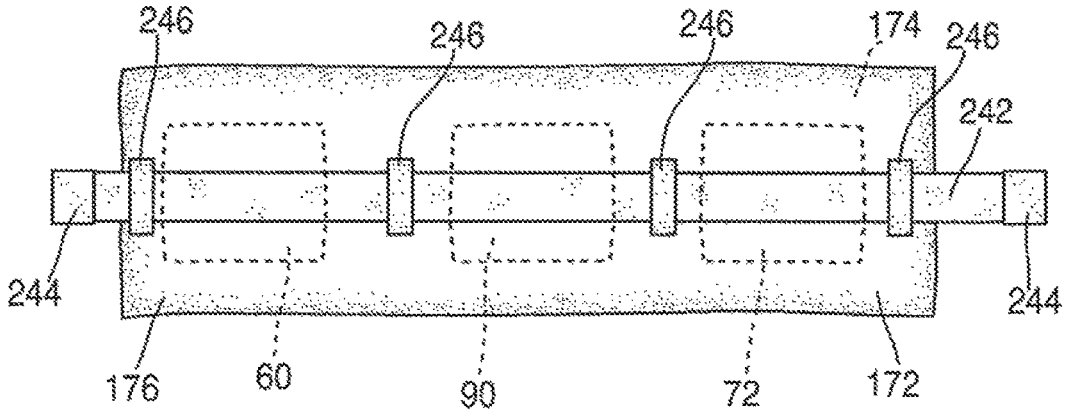
Figure 16C:
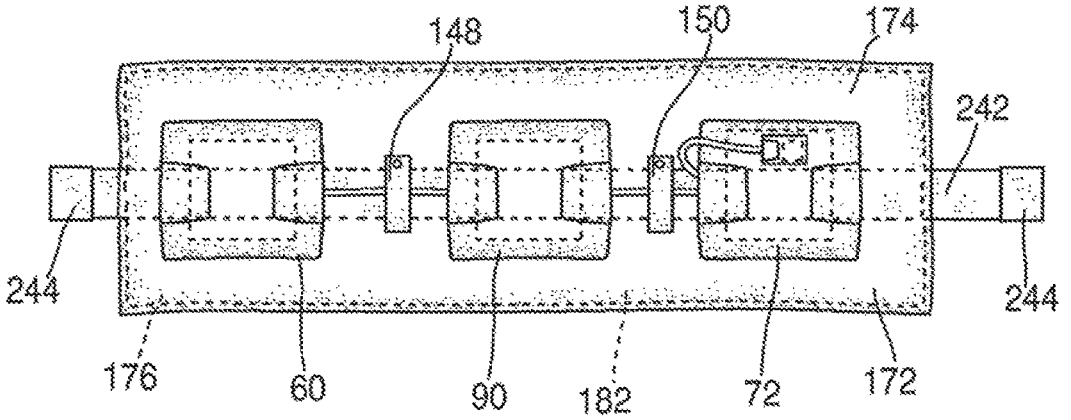

As shown in FIGS. 16A-16C, other strap 242 arrangements are also contemplated. Referring now to FIG. 16A, in a preferred embodiment, the strap 242 passes through the side openings 132, 136, 140, and 142 in the pockets 60, 72, and 90 attached to the first surface 174 of the inner liner panel 172. The strap 242 is also threaded through attachments 148 and 150. Preferably, but not necessarily, the attachments 148 and 150 are removable.

As shown in FIG. 16B, it is also contemplated that there are loops 246 attached to the second surface 176 of the inner liner panel 172. The strap 242 is threaded through the loops 246 on the second surface 176 of the inner liner panel 172. The loops 246 are preferably, but not necessarily, fixed at both ends to the inner liner panel 172.

FIG. 16C shows an alternate view of the embodiment shown in FIG. 15, with the strap 242 disposed between the inner liner panel 172 and the backing strip 182.

Figure 17:
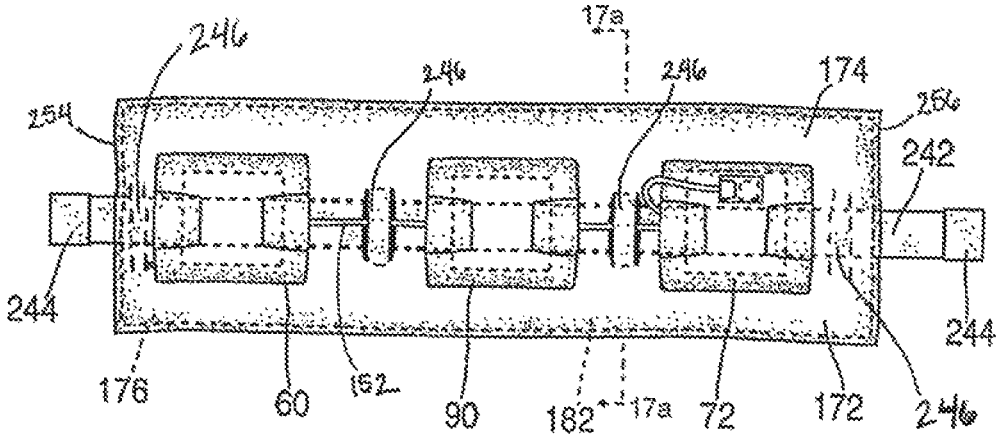
FIG. 17 is a front view of an alternate embodiment of an inner liner panel of FIG. 15.
Figure 17A:
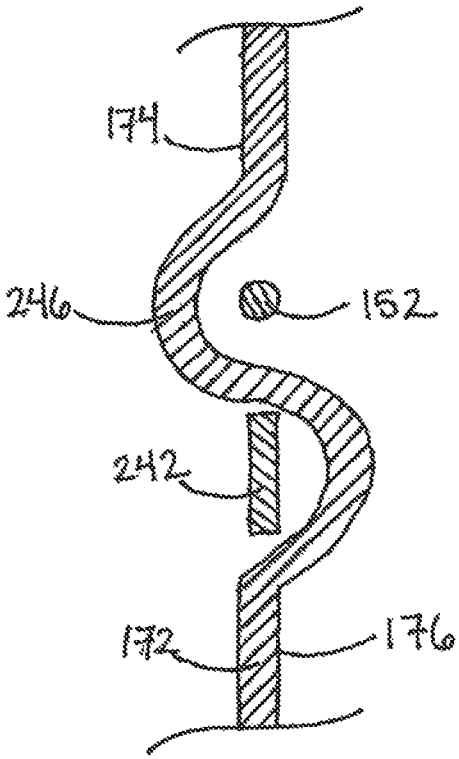
FIG. 17*a* is a cross-section taken along the line 17*a*-17*a* of FIG. 17 and in the direction generally indicated.

As shown in FIG. 17, it is also contemplated that slits are made in the inner liner panel 172 to form at least one and preferably a plurality of loops 246 that are integral with the inner liner panel 172. In a preferred embodiment, as shown in FIG. 17, the loops 246 extend outwardly from the first surface 174 of the inner liner panel 172, and the wire 152 threads through the loops 246. Alternatively, the loops 246 outwardly extend from the second surface 176 of the inner liner panel 172, and the strap 242 threads through the loops 246. Preferably, the first surface 174 of the inner liner panel 172 also has the loops 246 at both ends of the second surface 176 of the inner liner panel 172 to hold the strap 242. Alternatively, it is contemplated that the loops 246 to hold the strap 242 are readily disposed on the first surface 174. Finally, in an alternate embodiment as shown in FIG. 17*a*, both the strap 242 and wire 152 are threaded simultaneously through the loops 246, which form an "S" shape when viewed at the cross-section taken along the line 17*a*-17*a* in FIG. 17, in the direction indicated. The number and location of the loops 246 may vary to suit the application. In applications where the liner panel 172 is made of multiple layers, the loops 246 are optionally located in each layer, each loop extending generally normally from the corresponding web in a different direction.

Figure 18:
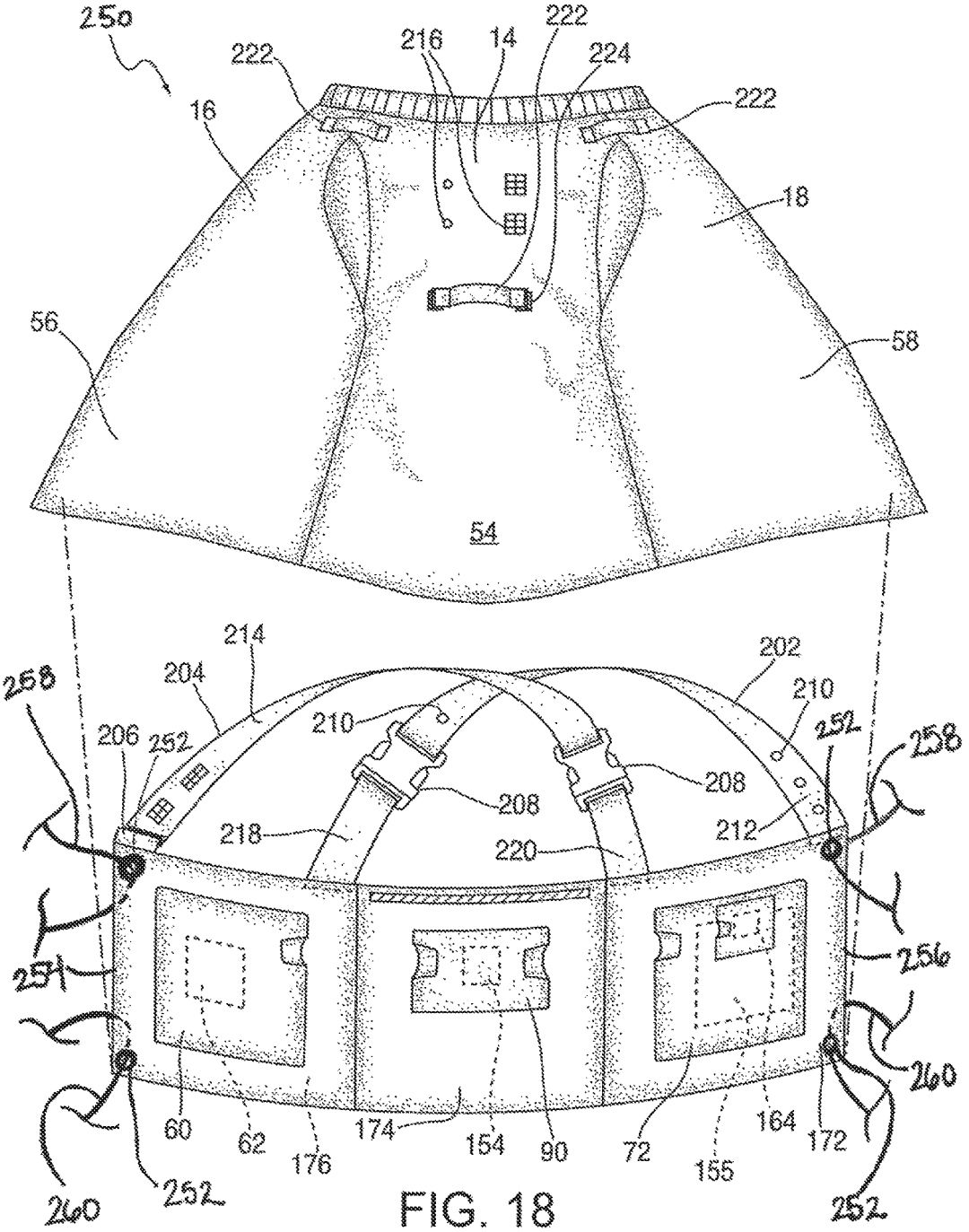
FIG. 18 is a front view of an alternate embodiment of a garment shown in FIGS. 12-14.

Referring now to FIG. 18, an alternate embodiment of the garment shown in FIGS. 12-14 is shown, generally designated 250. Components shared with the garment 10 are designated with identical reference numbers. A main feature of the garment 250 is that the inner liner panel 172 has grommet holes or eyelets 252 on the right and left side edges 254 and 256 of the inner liner panel 172 for straps in the form of cords 258 and 260. This allows a user to thread the cords 258 and 260 through the grommet holes 252 in the inner liner panel 172 and attach the right and left side edges 254 and 256 together by tying the inner liner panel 172 in a belt-like manner around the wearer's waist or torso with the cords 258 and 260.

Figure 19:
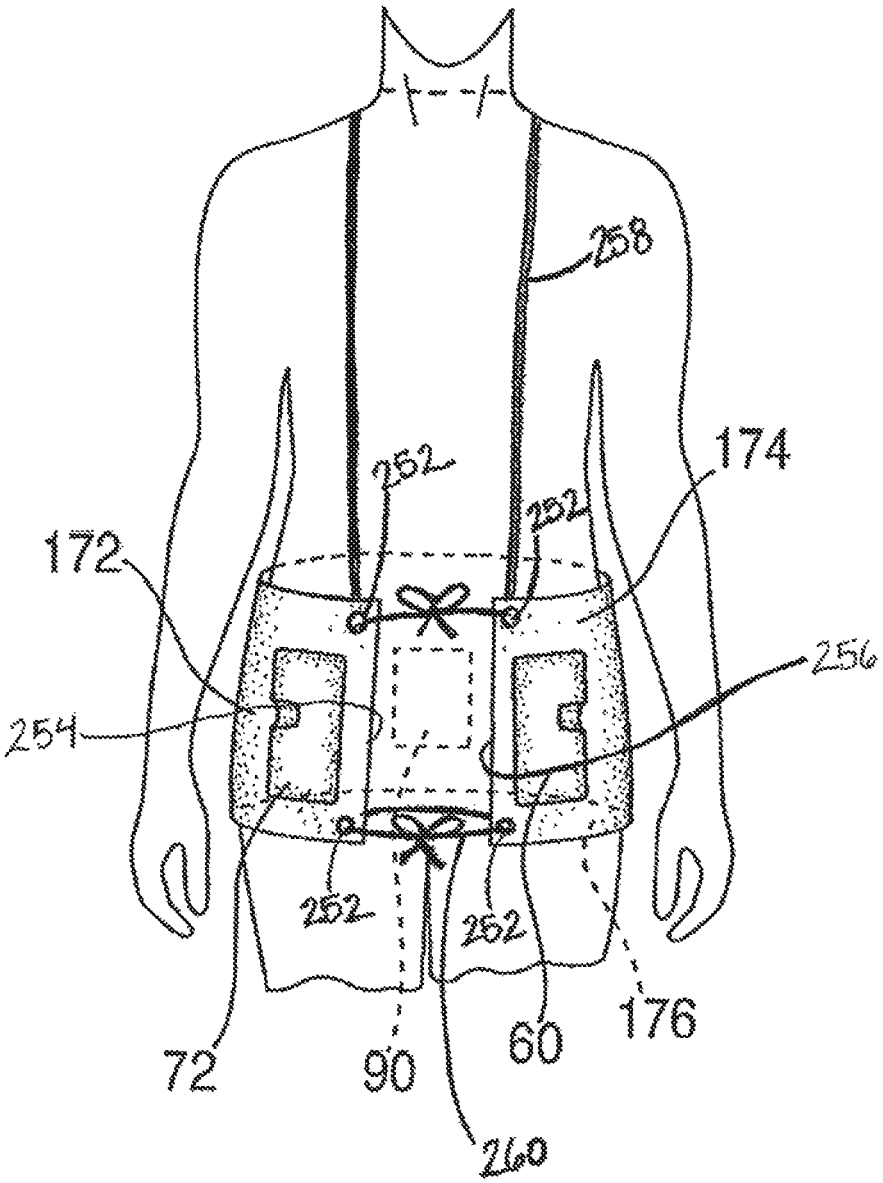
FIG. 19 is an alternate view of the embodiment shown in FIG. 18.

FIG. 19 shows an alternate view of the embodiment shown in FIG. 18, with the inner liner panel 172 tied using the cords 258 and 260 threaded through the grommet holes 252 around the wearer's waist. The cord 258 actually represents a pair of cords arranged as the straps 202, 204 are depicted in FIG. 13*d*, is threaded through the grommet holes 252, over the wearer's shoulders, and the ends of the cords 258 are tied together. Preferably, the cord 260 is also threaded through grommet holes 252 and the ends of the cord 260 are tied together. While this cord configuration has been shown and described in conjunction with FIG. 19, other cord configurations and attachments are contemplated. Alternatively, the at least one cord 258 is readily arranged corresponding to the alternate strap configurations depicted in FIGS. 13A-13D, using the grommet holes 252 to fasten the right and left side edges 254 and 256 together.

Figure 20:
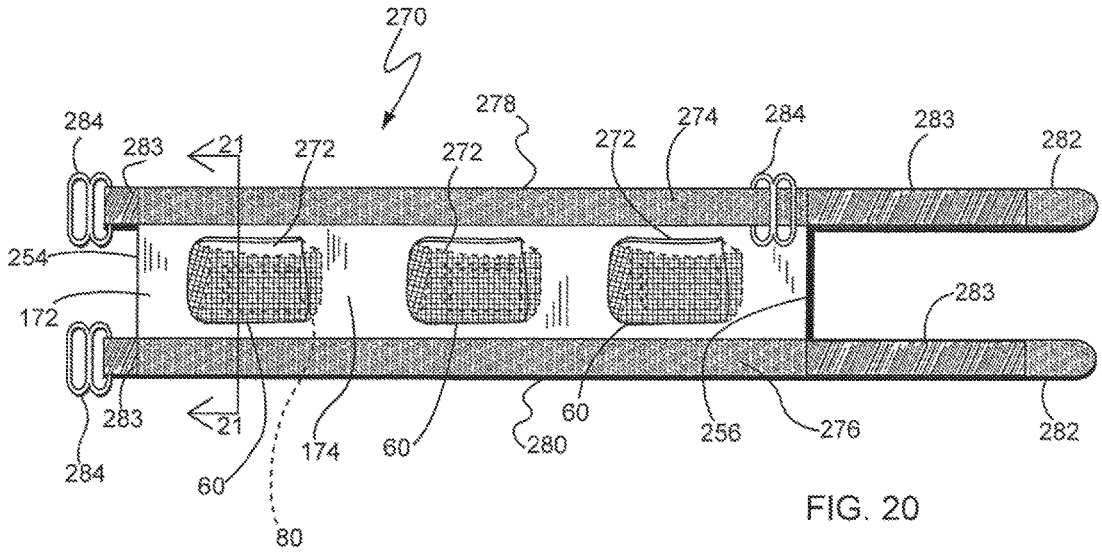
FIG. 20 is a front view of another alternate embodiment of the present temperature regulating garment.
Figure 21:
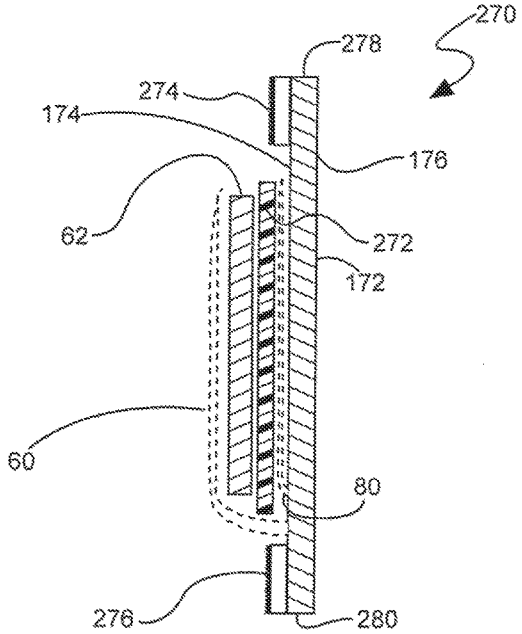
FIG. 21 is a cross-section taken along the lines 21-21 of FIG. 20 and in the direction indicated generally.
Figure 22:
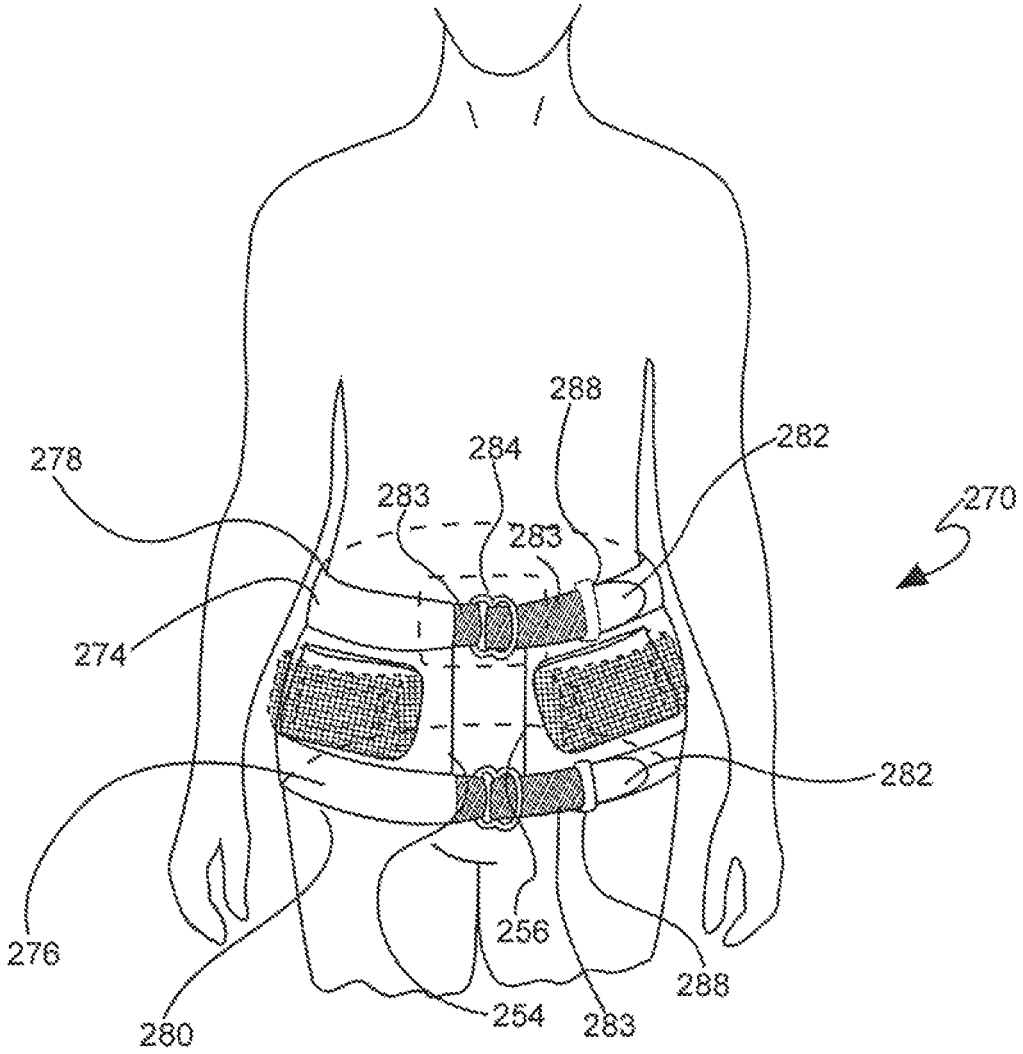
FIG. 22 is a schematic view of a person wearing the garment of FIGS. 20 and 21.

Referring now to FIGS. 20-22, an alternate embodiment of the garment is shown, generally designated 270. Components shared with the garments 10, 130, 170, 180, 190, 200, 240, 250 are designated with identical reference numbers. A main feature of the garment 270 is that it performs a temperature regulating function to space defined between the wearer's shirt and an overlying garment, such as a shirt, jacket, vest or the like. In this garment 270, a liner panel 172 worn on the body has the first or outer surface 174 having at least one and preferably a plurality of pockets 60. At least one of the pockets 60 has an internal pocket 80 (FIG. 21), making it a double pocket as described above in the previous embodiments. In the preferred embodiment, the pockets 60 are 9 inches wide and 6 inches tall, and the pockets 80 are 6 inches wide and 4 inches tall. It is contemplated that these dimensions are variable depending on the application, and that the pocket configuration may vary as described above in the other embodiments. In the preferred embodiment, the panel 172 is generally rectangular and has an axial length sufficient to wrap around a majority of an individual's torso and/or waist (FIG. 22). Different lengths or sizes of the panel 172 are contemplated to accommodate a variety of user torso sizes.

In the embodiment 270, the pockets 60, 80 are preferably made of a porous polyester mesh material for enhanced temperature radiation from the pockets, however other materials are contemplated. As is the case with the embodiment of FIGS. 12 and 13*a*-13*d*, the panel 172 is worn with the pockets 60, 80 facing away from the user's body. As such, the inner surface 176 faces the body. Accordingly, the panel 172 is preferably made of a soft, flexible textile material. Also, as is the case with the other embodiments, the pockets 60 are dimensioned for accommodating temperature control elements, such as heating packs, air-activated warmers, microwave warmed bags of IV fluid, cooling packs, phase change cooling elements, battery powered heating elements, battery powered electric cooling fans, or the like.

In this embodiment, the temperature regulating element 62 is preferably an air-activated warming pad, featuring known chemistry employing the heat generated from the exothermic oxidation of iron when exposed to air. More specifically, air-activated warming pads typically contain cellulose, iron, water, activated carbon for evenly distributing heat, vermiculite as a water reservoir and salt as a catalyst to produce heat from the exothermic oxidation of iron when exposed to air. Such pads emit heat for about 6 to 16 hours, depending on the formulation and the permeability to air. Such pads 62 have been found to generate temperatures in the range of 130-150° F. for at least as long as six hours. Electrically powered heating elements 62 using batteries are also contemplated, generating temperatures in the range of 100-180° F. depending on the voltage and resistance and for varying durations depending on battery capacitance as is known in the art. Alternatively, if cooling is desired, the element 62 is optionally a battery powered electric fan or a cooling pack as referred to above.

Another feature of the embodiment 270 is that a layer or pad 272 of insulative or heat resistant material, such as neoprene or the like is positioned in the pocket 60 adjacent the surface 174 and between the temperature control element 62 and the surface 174. This positioning is designed to protect the wearer from the significant heat or cold generated by some types of temperature control elements 62.

Still another feature of the embodiment 270 is that the attachment structure takes the form of the placement of upper and lower strips 274, 276 of preferably VELCRO® loop material along corresponding upper and lower edges 278, 280 of the panel 172. Other fastening materials or devices are contemplated. In the preferred embodiment slide adjusters 284 are fastened by a short segment of elastic strap 283 sewn in between the top and bottom edge 278, 280 VELCRO® loop material 274, 276 and the panel 172.

Attached to the panel 172 on upper and lower edges 278, 280 opposite to the side where the slide adjusters 284 are located are two elastic straps 283 approximately 12 inches in length. Attached to the ends of the straps 283 are 3 inch length pieces of double sided VELCRO® hook material 282. A further component is a supplemental loop preferably an additional slide adjuster 284 sewn in between the upper edge 278 strip of VELCRO® loop material 274 and the panel 172. An optional component would be another slide adjuster 284 sewn in between the lower edge 280 strip of VELCRO® loop material 276 and the panel 172. Instead of using a slide adjustor 284 in these locations, a supplemental belt loop 288 made of textile, metal, or the like that is optionally used to maintain the elastic straps 283 in alignment with the upper and lower edge 278, 280 VELCRO® loop material 274, 276.

Since the elastic straps 283 have 3 inch long double-sided VELCRO® hook ends 282, additional flexibility is afforded in fastening the panel 172 around a user's torso/waist. Either of the double-sided VELCRO® hook ends 282 can be passed through the slide adjuster 284 on the opposite side and then return to the side where it originated and attach to the upper or lower edge 278, 280 VELCRO® loop material 274, 276. The upper edge 278 VELCRO® double hook end 282 would pass through the additional slide adjuster 284 before it attaches to the upper edge 278 VELCRO® loop material 274 on the side where the elastic strap 283 originated. To accommodate a larger torso/waist, the elastic straps 283 with their double sided VELCRO® hook ends 282 can pass through the slide adjusters 284 on the opposite side and then continue on to attach to the upper and/or lower edge 278, 280 VELCRO® loop material 274, 276 on the opposite side from where they originated.

It is contemplated that features of the particular embodiments shown in FIGS. 1-22 are interchangeable, and that any of the described features of one embodiment can be used in combination with features of another embodiment.

While a particular embodiment of the present temperature regulating garment has been described herein, it will be appreciated by those skilled in the art that changes and modifications may be made thereto without departing from the invention in its broader aspects and as set forth in the following claims.

What is claimed is:

1. A garment for regulating temperature to be worn under an overlying garment, comprising:

a flexible panel separate from the overlying garment, having a first surface and a second surface, and right and left side edges, wherein said panel has an axial length sufficient to wrap around a majority of a wearer's torso or waist;

at least one attachment disposed on at least one of the first and second surfaces of the panel for securing said garment to the wearer's torso;

at least one pocket being fastened to the first surface of the panel facing away from the wearer's torso;

a layer of thermally insulative material positioned in said at least one pocket, separate from a wall of said pocket and only adjacent said first surface, so that an outer wall of said at least one pocket is free of any such material; and at least one temperature regulating element disposed inside one or more of said at least one pocket, each said at least one temperature regulating element configured for maintaining a desired temperature within a space under the overlying garment;

wherein said layer of insulative material is positioned between said at least one temperature regulating element and the panel.

2. The garment of claim 1 further including a battery pack connected to said at least one temperature regulating element for providing power to said element.

3. The garment of claim 1 wherein said temperature regulating element is an air-activated warming pad.

4. The garment of claim 1 wherein said layer of insulative material is a pad.

5. The garment of claim 1 further including grommet holes or eyelets on the right and left side of edges for threading at least one cord.

6. The garment of claim 1 wherein said at least one attachment is a plurality of strips made of loop material extending along at least one of upper and lower edges of the panel.

7. The garment of claim 6 further comprising elastic straps, double-sided ends made of hook material and at least one slide adjuster.

8. The garment of claim 7 further comprising at least one supplemental belt loop.

9. The garment of claim 1 wherein said at least one attachment is at least one length-adjustable shoulder strap attached to the second surface of the panel.

10. The garment of claim 9 wherein said at least one shoulder strap is permanently attached by stitching, adhesive, or the like.

11. The garment of claim 1 wherein at least one of said at least one pocket is a double pocket.

12. A combination of an overlying garment and a garment for regulating temperature to be worn under said overlying garment, comprising:

a garment including a flexible panel having a first surface and a second surface, and right and left side edges, wherein said panel has an axial length sufficient to wrap around a majority of a wearer's torso or waist;

at least one attachment disposed on at least one of the first and second surfaces of the panel for securing said garment to the wearer's torso;

at least one pocket being fastened to the first surface of the panel facing away from the wearer's torso;

a layer of thermally insulative material positioned in said at least one pocket separate from a wall of said pocket, and only adjacent said first surface, so that an outer wall of said at least one pocket is free of any such material;

at least one temperature regulating element disposed inside one or more of said at least one pocket, each said at least one temperature regulating element configured for maintaining a desired temperature within a space under the overlying garment;

wherein said layer of insulative material is positioned between said at least one temperature regulating element and the panel; and an overlying garment constructed and arranged for being worn over said garment, and said garment is constructed and arranged so that said temperature regulating element regulates temperature in a space defined between said garment and said overlying garment.

13. The garment of claim 12 wherein said overlying garment is one of a jacket and a vest.

14. A garment for regulating temperature to be worn under an overlying garment, comprising:

a flexible panel separate from the overlying garment, having a first surface and a second surface, and right and left side edges, wherein the panel has an axial length sufficient to wrap around a majority of a wearer's torso or waist;

at least one pocket being fastened to the first surface of the panel facing away from the wearer's torso;

at least one strip made of hook and loop fastening material extending along at least one of upper and lower edges of the panel;

at least one elastic strap with a first end attached to said at least one strip made of hook and loop fastening material;

at least one double-sided end attached to a second end of said at least one elastic strap, wherein said double-sided end is made of complementary hook and loop fastening material to be used with said at least one strip of hook and loop fastening material for securing said garment to the wearer's torso;

at least one slide adjuster associated with at least one of said strip and said strap; and a layer of thermally insulative material positioned in said at least one pocket.

15. The garment of claim 14 further comprising at least one temperature regulating element disposed inside one or more of said at least one pocket, each said at least one temperature regulating element configured for maintaining a desired temperature within a space under the overlying garment.

* * * * *